US011274457B2

(12) United States Patent
Sheehan et al.

(10) Patent No.: US 11,274,457 B2
(45) Date of Patent: Mar. 15, 2022

(54) FORMLINERS AND METHODS OF USE

(71) Applicant: Prime Forming & Construction Supplies, Inc., Santa Ana, CA (US)

(72) Inventors: Brian Eugene Sheehan, Mission Viejo, CA (US); Edward Daniel Fitzgerald, Laguna Beach, CA (US)

(73) Assignee: PRIME FORMING & CONSTRUCTION SUPPLIES, INC., Santa Ana, CA (US)

( * ) Notice: Subject to any disclaimer, the term of this patent is extended or adjusted under 35 U.S.C. 154(b) by 197 days.

(21) Appl. No.: 16/790,607

(22) Filed: Feb. 13, 2020

(65) Prior Publication Data

US 2020/0256072 A1 Aug. 13, 2020

Related U.S. Application Data

(63) Continuation-in-part of application No. 15/042,094, filed on Feb. 11, 2016, now abandoned.

(60) Provisional application No. 62/116,407, filed on Feb. 14, 2015.

(51) Int. Cl.
*E04G 17/00* (2006.01)
*B28B 7/00* (2006.01)

(52) U.S. Cl.
CPC ..... *E04G 17/00* (2013.01); *B28B 7/0073* (2013.01)

(58) Field of Classification Search
CPC ..... E04G 17/00; B28B 7/0073
See application file for complete search history.

(56) References Cited

U.S. PATENT DOCUMENTS

| | | | |
|---|---|---|---|
| 405,800 | A | 6/1889 | Ransome |
| 415,772 | A | 11/1889 | Fiske |
| 448,732 | A | 3/1891 | Sagendorph |
| 483,240 | A | 9/1892 | Sagendorph |
| 1,564,578 | A | 12/1925 | Kennedy |
| 1,592,591 | A | 7/1926 | Amele |
| 1,635,093 | A | 7/1927 | McPherson et al. |
| 1,636,396 | A | 7/1927 | Urschel |
| 1,669,639 | A | 5/1928 | Graham |

(Continued)

FOREIGN PATENT DOCUMENTS

| | | | |
|---|---|---|---|
| CN | 2318016 | Y | 5/1999 |
| CN | 101137805 | A | 3/2008 |

(Continued)

OTHER PUBLICATIONS

International Search Report and Written Opinion received in corresponding PCT Application No. PCT/US2009/058489, dated Feb. 10, 2010, 14 pages.

(Continued)

*Primary Examiner* — Leith S Shafi
(74) *Attorney, Agent, or Firm* — Knobbe, Martens, Olson & Bear, LLP

(57) ABSTRACT

Features for formliners to form a decorative pattern in a curable material and methods of using the same are disclosed. An improved formliner is disclosed with seamlessly connecting components that reduces the need for using adhesives for interconnecting a plurality of formliners in a pattern. Further, the formliner is configured to reduce and/or substantially eliminate visible seams in order to create a more natural appearance in a finished product of the curable material.

26 Claims, 12 Drawing Sheets

(56) References Cited

U.S. PATENT DOCUMENTS 1,734,826 A 11/1929 Israel
1,750,511 A 3/1930 Dunn
1,809,504 A 6/1931 Carvel
1,961,627 A 6/1934 Wilber
2,209,283 A 7/1940 Ronzone
2,241,898 A 5/1941 Bawtenheimer
2,245,047 A 6/1941 Odell
2,246,377 A 6/1941 Mattes
2,339,489 A 1/1944 Kublanow
2,397,388 A 3/1946 Troedsson
2,595,142 A 4/1952 Herck
2,616,145 A 11/1952 Dufford
2,627,100 A 2/1953 Tom
2,627,744 A 2/1953 Lopina
2,807,070 A 9/1957 Thomas
2,931,130 A 4/1960 Rietz
3,096,195 A 7/1963 Seman et al.
3,177,279 A 4/1965 Bilodeau
3,426,490 A 2/1969 Taylor
3,511,004 A 5/1970 Snellings
3,524,790 A 8/1970 Mason
3,602,476 A 8/1971 Iragorri
3,657,849 A 4/1972 Garton
3,664,630 A 5/1972 Maynen et al.
3,678,887 A 7/1972 Smith
3,692,458 A 9/1972 Kirsch
3,780,977 A 12/1973 Dashew
3,820,295 A 6/1974 Folley
3,868,801 A 3/1975 Weiner
3,974,602 A 8/1976 Pohl et al.
4,015,391 A 4/1977 Epstein et al.
4,026,083 A * 5/1977 Hoyt ..... E04F 13/0862 52/387
4,061,809 A 12/1977 Mautner
4,211,504 A 7/1980 Sivachenko
4,265,443 A 5/1981 Berthelot
4,290,248 A 9/1981 Kemerer et al.
4,407,480 A 10/1983 Trimmer et al.
4,495,738 A 1/1985 Sheber
4,557,086 A 12/1985 Liefer et al.
4,576,536 A 3/1986 Benuzzi
4,695,033 A 9/1987 Imaeda et al.
4,741,137 A 5/1988 Barratt
4,773,790 A 9/1988 Hagenah
4,858,410 A * 8/1989 Goldman ..... E04F 13/0862 52/591.5
4,888,928 A 12/1989 Rea et al.
4,932,182 A * 6/1990 Thomasson ..... E04F 15/12 404/18
4,986,726 A 1/1991 Benuzzi et al.
5,002,817 A 3/1991 Jones
5,009,387 A 4/1991 Scott et al.
5,061,161 A 10/1991 Tetu
D330,435 S 10/1992 Dukart et al.
5,268,137 A 12/1993 Scott et al.
5,347,784 A 9/1994 Crick et al.
5,372,349 A 12/1994 Elmore
5,487,526 A * 1/1996 Hupp ..... B28B 7/24 249/129
5,501,049 A 3/1996 Francis et al.
5,537,792 A 7/1996 Moliere
5,632,922 A 5/1997 Nasvik et al.
5,887,846 A 3/1999 Hupp
6,041,567 A * 3/2000 Passeno ..... B28B 19/0061 249/96
6,086,172 A 7/2000 Lee
6,129,329 A 10/2000 Nasvik
6,324,812 B1 12/2001 Drya-Lisiecka
6,421,975 B2 7/2002 Bryant et al.
6,516,578 B1 2/2003 Hunsaker
D479,614 S 9/2003 Scott et al.
6,631,598 B2 10/2003 Raineri
6,634,617 B2 10/2003 Potvin
6,715,250 B2 4/2004 Bryant et al.
6,857,248 B2 2/2005 Ouellet et al.
6,955,019 B2 10/2005 Donlin et al.
7,306,757 B2 12/2007 Harrington
7,313,863 B2 1/2008 Li et al.
7,513,523 B2 4/2009 Bayley et al.
7,527,236 B2 5/2009 Nasvik
7,626,242 B2 12/2009 Krishnan
7,647,738 B2 1/2010 Nasvik
7,658,050 B2 2/2010 Bouchard et al.
7,790,784 B2 9/2010 Nasr
7,840,890 B2 11/2010 Lund
7,856,780 B2 12/2010 Durnberger
7,871,054 B2 * 1/2011 Walters ..... B28B 19/0061 249/15
7,901,757 B2 3/2011 Strout et al.
7,955,550 B2 6/2011 Polk, Jr. et al.
7,963,499 B2 6/2011 Fitzgerald et al.
8,074,957 B2 * 12/2011 Fitzgerald ..... E04F 15/02194 249/16
8,151,530 B2 4/2012 Schwarz
8,166,882 B2 5/2012 Yang
8,181,930 B2 5/2012 Fasching
8,205,404 B2 6/2012 Vermeulen et al.
8,297,016 B2 10/2012 Sukup et al.
8,321,237 B2 11/2012 Dogac et al.
8,365,491 B2 2/2013 Schrunk
8,387,167 B2 3/2013 Matsunobu et al.
D696,870 S 1/2014 Vidal Soler
8,621,801 B2 1/2014 Bouchard
8,623,257 B2 * 1/2014 Fitzgerald ..... E04F 21/04 264/299
8,636,261 B2 * 1/2014 Walters ..... B28B 19/0061 249/15
D701,623 S 3/2014 Vidal Soler
D701,625 S 3/2014 Vidal Soler
8,662,467 B2 3/2014 Fasching et al.
D701,976 S 4/2014 Vidal Soler
8,697,937 B2 4/2014 Roe et al.
8,697,938 B2 4/2014 Roe et al.
8,708,326 B2 4/2014 Egli et al.
8,741,410 B2 6/2014 Cattacin et al.
8,824,129 B2 9/2014 Wang et al.
D715,459 S 10/2014 Perry
8,863,461 B2 10/2014 Wagner et al.
8,888,067 B1 * 11/2014 Calmes ..... B28B 19/0061 249/15
8,992,203 B2 * 3/2015 Fitzgerald ..... B28B 7/0073 425/182
9,027,302 B2 5/2015 Buoni
D740,449 S 10/2015 Huang
9,169,652 B2 10/2015 Steffes
9,528,274 B2 12/2016 Curtis
9,574,308 B2 2/2017 Castonguay et al.
D791,364 S * 7/2017 Sheehan ..... D25/199
9,909,322 B1 3/2018 Sadleir
D818,612 S 5/2018 Elmaagacli
10,137,598 B2 11/2018 Fitzgerald et al.
10,406,721 B2 9/2019 Fitzgerald et al.
D875,277 S 2/2020 Sheehan et al.
10,723,040 B2 7/2020 Fitzgerald et al.
2001/0005565 A1 6/2001 Fujimoto
2001/0020669 A1 * 9/2001 Potvin ..... B28B 7/0073 249/112
2001/0025554 A1 10/2001 Benuzzi
2002/0135987 A1 9/2002 Baldwin et al.
2004/0194421 A1 10/2004 Canti
2005/0064128 A1 * 3/2005 Lane ..... E04F 13/185 428/44
2005/0097827 A1 5/2005 Jordan
2005/0144763 A1 7/2005 Boville
2005/0184441 A1 8/2005 Munneke
2005/0188642 A1 9/2005 Correia
2005/0210811 A1 9/2005 Nasvik
2006/0003132 A1 1/2006 Correia et al.
2006/0008619 A1 1/2006 Campbell et al.
2006/0091282 A1 5/2006 Walters
2006/0157634 A1 * 7/2006 Nasvik ..... B28B 7/0073 249/16

(56) References Cited

U.S. PATENT DOCUMENTS

| | | | | |
|---|---|---|---|---|
| 2006/0180731 | A1* | 8/2006 | Scott | B29C 66/47 249/15 |
| 2006/0197257 | A1 | 9/2006 | Burt | |
| 2007/0130860 | A1 | 6/2007 | Paquette | |
| 2007/0137127 | A1 | 6/2007 | Lincoln | |
| 2007/0137128 | A1 | 6/2007 | Viau | |
| 2007/0166102 | A1 | 7/2007 | Cornaz | |
| 2007/0175261 | A1 | 8/2007 | Hornig et al. | |
| 2007/0217865 | A1 | 9/2007 | Castonguay et al. | |
| 2008/0099985 | A1 | 5/2008 | Ogawa | |
| 2008/0107765 | A1 | 5/2008 | Considine et al. | |
| 2008/0143040 | A1 | 6/2008 | Chung et al. | |
| 2008/0156205 | A1 | 7/2008 | Hering | |
| 2008/0164294 | A1 | 7/2008 | Hafner | |
| 2008/0222986 | A1 | 9/2008 | Hamel | |
| 2008/0233352 | A1 | 9/2008 | Smith et al. | |
| 2008/0233377 | A1 | 9/2008 | Smith et al. | |
| 2008/0319409 | A1 | 12/2008 | Roe et al. | |
| 2008/0319410 | A1 | 12/2008 | Roe et al. | |
| 2009/0062413 | A1 | 3/2009 | Adur et al. | |
| 2009/0092461 | A1 | 4/2009 | Bubulka et al. | |
| 2009/0100774 | A1* | 4/2009 | Fasching | B29D 99/0014 52/391 |
| 2009/0294896 | A1 | 12/2009 | Krishnan | |
| 2009/0295062 | A1 | 12/2009 | Sheng | |
| 2010/0015405 | A1 | 1/2010 | Bechtold et al. | |
| 2010/0166997 | A1 | 7/2010 | Chisaka et al. | |
| 2010/0236175 | A1 | 9/2010 | King | |
| 2011/0061323 | A1 | 3/2011 | Schwarz | |
| 2011/0289867 | A1 | 12/2011 | Balbo Di Vinadio | |
| 2012/0245545 | A1 | 9/2012 | Roe et al. | |
| 2012/0322333 | A1 | 12/2012 | Melamed et al. | |
| 2013/0026896 | A1 | 1/2013 | Chang et al. | |
| 2013/0075576 | A1* | 3/2013 | Calmes | B28B 19/0061 249/112 |
| 2013/0104616 | A1 | 5/2013 | Masek et al. | |
| 2013/0216754 | A1 | 8/2013 | Chisaka et al. | |
| 2013/0232710 | A1 | 9/2013 | Policicchio | |
| 2013/0341258 | A1 | 12/2013 | Sekora | |
| 2014/0076505 | A1 | 3/2014 | Mullet et al. | |
| 2014/0131368 | A1 | 5/2014 | Dygert et al. | |
| 2014/0171897 | A1 | 6/2014 | Roe et al. | |
| 2014/0173844 | A1 | 6/2014 | Pickard, III | |
| 2014/0183808 | A1 | 7/2014 | Egli et al. | |
| 2014/0183809 | A1 | 7/2014 | Egli et al. | |
| 2014/0202106 | A1 | 7/2014 | Wagner et al. | |
| 2014/0202109 | A1 | 7/2014 | Michalski et al. | |
| 2014/0239585 | A1 | 8/2014 | Doucet et al. | |
| 2014/0242330 | A1 | 8/2014 | Song | |
| 2014/0251764 | A1 | 9/2014 | Gieser et al. | |
| 2015/0218829 | A1 | 8/2015 | Curtis | |
| 2016/0010346 | A1 | 1/2016 | Calmes | |
| 2016/0237704 | A1 | 8/2016 | Sheehan | |
| 2018/0243956 | A1 | 8/2018 | Salenius | |
| 2019/0168415 | A1 | 6/2019 | Fitzgerald et al. | |
| 2020/0101638 | A1 | 4/2020 | Fitzgerald et al. | |

FOREIGN PATENT DOCUMENTS

| | | | |
|---|---|---|---|
| CN | 101563238 | A | 10/2009 |
| CN | 102224309 | | 10/2011 |
| DE | 8906516 | U1 | 9/1989 |
| EP | 0338663 | A1 | 10/1989 |
| EP | 1308253 | | 5/2003 |
| GB | 363637 | | 12/1931 |
| JP | 62-49518 | U | 3/1987 |
| WO | WO 2010/036971 | | 4/2010 |
| WO | WO 2014/088391 | A1 | 6/2014 |

OTHER PUBLICATIONS

International Preliminary Report on Patentability and Written Opinion of the International Searching Authority received in corresponding PCT Application No. PCT/US2009/058489, dated Mar. 29, 2011, 7 pages.

International Search Report and Written Opinion received in corresponding PCT Application No. PCT/US2016/036598, dated Sep. 6, 2016, 11 pages.

Innovative Brick Systems LLC, "Techinical Design and Installation Guide for the MBrick Versa Liner", Sep. 2004, www.innovativebrick.com, Rev. 3.

Supplementary European Search Report issued in European Patent Application No. 16882215.3, dated Aug. 9, 2019, in 9 pages.

Extended European Search Report issued in European Patent Application No. 19202687.0, dated Mar. 23, 2020, in 7 pages.

Custom Rock 12019 Formliner Ashlar I Hunt Valley Distributors (on-line), no date available. Retrieved from Internet Jul. 16, 2019, URL: https://www.huntvalleydistributors.com/custom-rock-12019-formliner-ashlar (2 pages).

Masonry—Fitzgerald Formliners (on-line), dated Nov. 29, 2017. Retrieved from Internet Jul. 16, 2019, URL: https://web.archive.org/web/20171129183821/httDs://formliners.com/masonry/ (3 pages) (Year: 2017).

* cited by examiner

FORMLINERS AND METHODS OF USE

INCORPORATION BY REFERENCE TO ANY PRIORITY APPLICATIONS

Any and all applications for which a foreign or domestic priority claim is identified in the Application Data Sheet as filed with the present application are incorporated by reference and made a part of this specification.

BACKGROUND

Field of the Inventions

The present disclosure relates generally to formliners and methods of using the same. More specifically, the present disclosure relates to an improved formliner for creating a desired pattern in curable material while minimizing visible seams in the curable material.

Description of the Related Art

Decorative masonry and concrete construction have become increasingly popular in recent years. The façades of homes and other buildings that had previously been constructed in very simple and plain concrete are now being replaced with either decorative stone and brick or decorative concrete construction.

As a result of the increased demand for stone and brick work, various improvements have been made in stone and brick masonry and concrete construction. These improvements have lowered the cost for such construction by decreasing the time or skill requirements previously needed to perform such work.

For example, in stone and brick masonry, facings and floors have been traditionally constructed by skilled artisans from individual units. However, recent advances have been made in the masonry art which allow artisans to more quickly and accurately perform stone or brick work. In particular, various panels, forms, and mounting systems have been developed that allow individual units to be placed in precise geometric patterns, thus eliminating much of the painstaking effort usually expended by the artisan. This now allows generally unskilled artisans, such as the do-it-yourselfer, to create a high-quality product.

Perhaps more importantly for projects with a tighter budget, advances in concrete construction now allow artisans to create a faux stone or brick appearance in concrete with a formliner. As a result, one may achieve the appearance of stone or brick without the associated cost.

A concrete formliner generally comprises an interior surface onto which concrete is poured. The interior surface of the formliner typically includes a desired pattern or shape that will be transferred to the concrete to form a cured concrete casting. In many cases, the formliner is lined up with additional formliners to create a pattern over a wide area.

After the concrete has cured, the formliners are removed from the exposed surface of the concrete, thus revealing the desired pattern or shape. Such patterns or shapes can include faux stone or brick, wave patterns, emblems, etc.

SUMMARY

As noted above, in recent years, significant advances have been made in the art of concrete laying. Various techniques and equipment have been developed that allow for the creation of decorative patterns in the concrete, especially a faux stone or brick appearance. The results of such techniques and equipment provide the appearance of stone or brick without the cost. The curable material or concrete casting can be created in a horizontal (such as for tilt up construction) or vertical casting process, and can be pre-cast, or cast-at-site construction.

The present disclosure discloses an improved formliner with seamlessly connecting components that eliminates the need for using adhesives for interconnecting a plurality of formliners in a pattern. Further, the formliner is configured to reduce and/or eliminate visible seams in order to create a more natural appearance in a finished product.

However, according to at least one of the formliners disclosed herein is the realization that in using multiple formliners, seams are created between the formliners where the formliners meet. For example, in order to create a large pattern or casting with prior art formliners, the formliners are merely placed together using butt joints, thus creating significant visible seams between the formliners. As a result, the appearance of the exposed surface of the concrete is compromised. An unsightly seam is very easy to notice and takes a substantial amount of time and effort to remove from cured concrete. Further, in large-scale projects, it may be too costly to re-work the cured concrete in order to remove the seams. As such, the seams are simply left in place resulting in an inferior concrete product.

Thus, the present inventions provide for formliners and methods of use. For example, the formliner can have one or more cells and one or more raised sections or ribs, wherein the formliner is shaped and configured to be interconnected with other such formliners to create a pattern or array of formliners which nest with each other such that an applied material provides a natural appearance and does not show seaming between the formliners that were interconnected to create the pattern. As discussed herein, there are various features that can be incorporated into this broad conception of the formliner in order to provide various features of the formliner. In the present description, the disclosed features can optionally be incorporated into the above-noted formliner and its method of use in any combination. Additionally, Applicants describe some of these features and methods in patent applications, such as International Patent Application No. PCT/US2009/058489, filed Sep. 25, 2009, U.S. patent application Ser. No. 12/406,896, filed Mar. 18, 2009, U.S. patent application Ser. No. 12/850,510, filed Aug. 4, 2010, and U.S. patent application Ser. No. 12/238,294, filed Sep. 25, 2008, the entireties of which are incorporated herein by reference and made a part of this specification.

A method is also provided for transferring a decorative pattern to an exposed surface of a curable material. The method comprises providing a plurality of formliners, each formliner comprising one or more shaped regions being bounded by ridges, each formliner defining overlapped ridges and overlapping ridges. The method can comprise engaging a first formliner with a second formliner by overlaying overlapping ridges of the first formliner onto overlapped ridges of the second formliner. For example, the method can comprise abutting an opening formed in the overlapping ridge of the first formliner with a transition zone formed in the second formliner, the transition zone being formed between the overlapped ridge and a non-overlap ridge of the second formliner. The method can also comprise placing the curable material against the first and second formliners, for example, to transmit a decorative pattern formed by the shaped regions of the first and second formliners to the curable material.

Each formliner can comprise non-overlap or non-overlapping ridges and at least one opening formed in the overlapping ridges. Thus, the method can further comprise overlaying the overlapping ridges of the first formliner onto the overlapped ridges of the second formliner with a non-overlap ridge of the second formliner extending from an opening of the overlapping ridges of the first formliner. The non-overlap ridge of the second formliner can be interconnected with and extend from the overlapped ridge of the second formliner.

The non-overlap ridge of the second formliner can be separated from the overlapped ridge of the second formliner by a transition zone formed in the second formliner, and the method further comprises abutting the opening of the first formliner with the transition zone of the second formliner. The overlapping ridge and the non-overlap ridge can have generally the same exterior cross-sectional profile. The opening can be formed as an open end of the overlapping ridge of the first formliner.

The overlapping ridges of the first formliner can define an interior cross-sectional profile that is greater than an exterior cross-sectional profile of the overlapped ridges of the second formliner. The method can comprise engaging a third formliner with the first formliner and the second formliner. The third formliner can comprise overlapping ridges and overlapped ridges. One of the first, second, and third formliners can comprise a sub-overlapped ridge section that defines an exterior cross-sectional profile that is less than an interior cross-sectional profile of the overlapped ridges.

For example, the sub-overlapped ridge section can be formed along a corner of a boundary of the third formliner. The method can comprise overlaying an overlapped ridge onto the sub-overlapped ridge section. Thus, the third formliner can comprise the sub-overlapped ridge section formed along a corner of a boundary of the third formliner, and the first formliner and the second formliner can overlap the third formliner at the sub-overlapped ridge section of the third formliner.

The first formliner and the second formliner can each comprise at least one row with a projecting cell bordered in at least one adjacent row with a non-projecting cell, and the method can comprise engaging the first formliner and the second formliner with a projecting cell in a first row of the first formliner being positioned adjacent to a non-projecting cell in a first row of the second formliner and a projecting cell in a second row of the second formliner being positioned adjacent to a non-projecting cell in a second row of the first formliner.

The method can also comprise: interconnecting a first formliner with a second formliner by overlaying a first section of a rib of the first formliner onto a second section of a rib of the second formliner such that the second section of the rib of the second formliner is nested within a recess of the first section of the rib of the first formliner; and positioning an exterior surface of the first section of the rib of the first formliner flush with an exterior surface of a first section of the rib of the second formliner upon nesting of the second section of the second formliner within the first section of the first formliner.

The method can further comprise interconnecting a third formliner with the first and second formliners by overlaying at least one of the first section of the rib of the first formliner or a first section of the rib of the second formliner onto a second section of a rib of the third formliner. Further, the method can comprise positioning an exterior surface of a first section of the rib of the third formliner flush with the exterior surface of the first section of the rib of one of the first or second formliners.

The method can further comprise interconnecting a third formliner with the first and second formliners by overlaying a first section of the third formliner onto at least one of the second section of the rib of the first formliner or a second section of the rib of the second formliner. The method can further comprise interconnecting a fourth formliner with the first, second, and third formliners by overlaying a first section of the fourth formliner onto at least one of the second section of the rib of the first formliner, a second section of the rib of the second formliner, or a second section of the rib of the third formliner. The method can comprise positioning an exterior surface of a first section of the rib of the fourth formliner flush with the exterior surface of the first section of the rib of one of the first, second, or third formliners.

Additionally, the method can further comprise mating an opening in the first section of the first formliner against a transition zone of the second formliner such that visible seams in the decorative pattern are minimized when the first formliner and the second formliner are interconnected in use. The transition zone can be formed between the first and second sections of the rib of the second formliner. Further, the opening can be formed as an open end of the first section of the first formliner.

According to this disclosure, a formliner for use with a framework to create a decorative pattern on curable material includes one or more of the following: a cell comprising a base configured to face the curable material in use, wherein the base extends along a backing of the framework and at least a part of the base contacts the backing of the framework when the formliner is in use with the framework, wherein the framework is configured to support the formliner in a desired position; and a rib system comprising a plurality of ribs extending along the cell and forming at least a part of a boundary of the cell. The rib system includes one or more of the following: an overlapping section connected with the cell and comprising a first rib edge, the overlapping section configured to face the curable material in use; and an overlapped section connected with the cell and comprising a second rib edge, at least a portion of the overlapping section configured to overlay onto at least a portion of the overlapped section. An inner periphery is formed where the overlapped section connects with the base of the cell, the inner periphery extending generally along the boundary of the cell and extending generally along the framework when the formliner is in use with the framework. The first rib edge extends along the boundary of the cell without contacting the inner periphery of the cell when the at least a portion of the overlapping section overlays onto the at least a portion of the overlapped section. The second rib edge extends along the boundary of the cell, the second rib edge extending toward the backing of the framework such that the second rib edge provides structural support to the overlapped section and the overlapping section when the at least a portion of the overlapping section overlays onto the at least a portion of the overlapped section and when the formliner is in use with the framework.

According to this disclosure, the formliner further includes one or more of the following: the second rib edge contacts the backing of the framework to provide structural support to the overlapped section and the overlapping section when the at least a portion of the overlapping section overlays onto the at least a portion of the overlapped section and when the formliner is in use with the framework; the overlapping section comprises a first wall and a second wall connected to the first wall, wherein the overlapped section comprises a first wall, a second wall connected to the first wall of the overlapped section, and a third wall connected to the second wall of the overlapped section, wherein the first wall of the overlapping section is configured to overlap the third wall of the overlapped section, and wherein the second wall of the overlapping section is configured to overlap the second wall of the overlapped section; the second wall of the overlapping section comprises the first rib edge of the overlapping section; the third wall of the overlapped section comprises the second rib edge of the overlapped section; the first wall of the overlapping section connected to the second wall of the overlapping section forms a generally L-shaped cross-sectional profile; the second wall of the overlapped section connected to the first wall of the overlapped section and the third wall of the overlapped section connected to the second wall of the overlapped section forms a generally C-shaped cross-sectional profile; the first rib edge extends along a corner formed by the second wall of the overlapped section connecting to the first wall of the overlapped section when the at least a portion of the overlapping section overlays onto the at least a portion of the overlapped section; the first rib edge is on the corner when the at least a portion of the overlapping section overlays onto the at least a portion of the overlapped section; the overlapping section forms a first cross-sectional profile and the overlapped section forms a second cross-sectional profile having a length, wherein the first cross-sectional profile is configured to overlap the second cross-sectional profile over about two-thirds of the length when the at least a portion of the overlapping section overlays onto the at least a portion of the overlapped section; the overlapped section connects with the cell at the base of the cell, wherein the inner periphery is formed along the connection between the overlapped section and the base; at least some of the plurality of ribs are substantially polygonal shaped; a first formliner is configured to be assembled with a second formliner by overlaying at least a portion of an overlapping section of the second formliner onto at least a portion of an overlapped section of the first formliner such that an exterior surface of the overlapping section of the second formliner is flush with exterior surfaces of a rib system of the first formliner; exterior surfaces of the rib system are configured to face the curable material in use; the system further includes a plurality of non-overlap ribs; the rib system further includes a transition zone between the internal ribs and the overlapped section, the transition zone connecting the overlapped section with the non-overlap ribs, and wherein a first rib edge of the second formliner is positioned adjacent a transition zone of the first formliner when the first and second formliners are assembled; the transition zone comprises a varying cross-sectional profile increasing from the overlapped section to the non-overlap ribs; the non-overlap ribs comprise overlapping sections of the rib system; the first and second formliners are configured to be connected with at least one other formliner, wherein the overlapped section comprises a cutout such that the overlapped section of the second formliner is not overlapped by an overlapping section of the at least one other formliner when the first, second, and at least one other formliners are assembled; the cutout is positioned at a corner of the formliner, the corner of the formliner formed by an intersection of the plurality of ribs of the rib system; the cell is generally a rectangular shape; the formliner comprises a plurality of cells, and wherein the plurality of ribs are disposed between the plurality of cells to form boundaries of the cells; the plurality of cells define a generally rectangular shape; the cells are of different sizes; the plurality of cells includes opposing ends, the plurality of cells being arranged in a plurality of layers with each layer having at least two cells disposed end-to-end; cells of a first layer of the plurality of layers are offset from cells of a second layer of the plurality of layers; the formliner comprises a first end and a second end, the first end being formed to include a first finger joint pattern and the second end being formed to include a second finger joint pattern that is complementary to the first finger joint pattern, wherein a first end of the second formliner is configured to be overlaid with a second end of the first formliner; the base comprises a textured pattern bounded by the rib system, wherein placing the curable material against the base and the rib system forms a textured surface in an exposed surface of the curable material where the base comprising the textured pattern directly contacts the exposed surface of the curable material; the textured pattern comprises at least one of brick, wood, rock, stone, faux stone, cut stone, sand stone, ledgestone, fieldstone, castle rock, river rock, or slate; and/or the textured pattern connects with the overlapped section to form the periphery.

According to this disclosure, a formliner for use in creating a decorative pattern on curable material includes one or more of the following: a cell comprising a contact surface configured to face the curable material in use, the contact surface extending generally along a plane; and a rib system extending along the cell and forming at least a part of a boundary of the cell. The rib system includes one or more of the following: an overlapping section comprising a first rib edge, the overlapping section configured to face the curable material in use; and an overlapped section comprising a second rib edge, at least a portion of the overlapping section configured to overlay onto at least a portion of the overlapped section. The overlapped section connecting with the cell forms a periphery extending generally along the boundary of the cell and generally along the plane. The first rib edge extends along the boundary of the cell without contacting the periphery of the cell when the at least a portion of the overlapping section overlays onto the at least a portion of the overlapped section. The second rib edge extends along the boundary of the cell, the second rib edge extending toward the plane.

According to this disclosure, the formliner further includes one or more of the following: the second rib edge extends into the plane; the overlapping section comprises a first wall and a second wall connected with the first wall, wherein the overlapped section comprises a first wall, a second wall connected with the first wall of the overlapped section, and a third wall connected with the second wall of the overlapped section, wherein the first wall of the overlapping section is configured to at least partially contact the third wall of the overlapped section, and wherein the second wall of the overlapping section is configured to overlap the second wall of the overlapped section; the second wall of the overlapping section comprises the first rib edge of the overlapping section; the third wall of the overlapped section comprises the second rib edge of the overlapped section; the first wall of the overlapping section coupled with the second wall of the overlapping section forms a generally L-shaped cross-sectional profile; the second wall of the overlapped section connected to the first wall of the overlapped section and the third wall of the overlapped section connected to the second wall of the overlapped section forms a generally C-shaped cross-sectional profile; the first rib edge extends along a corner formed by the second wall of the overlapped section connecting to the first wall of the overlapped section when the at least a portion of the overlapping section overlays onto the at least a portion of the overlapped section; the first rib edge is on the corner when the at least a portion of the overlapping section overlays onto the at least a portion of the overlapped section; the overlapping section forms a first cross-sectional profile and the overlapped section forms a second cross-sectional profile having a length, wherein the first-sectional profile is configured to overlap the second cross-sectional profile over about two-thirds of the length when the at least a portion of the overlapping section overlays onto the at least a portion of the overlapped section; the overlapped section connects with the cell at the contact surface of the cell, wherein the inner periphery is formed along the connection between the overlapped section and the contact surface; the rib system includes a plurality of ribs, and wherein each of the plurality of ribs is substantially polygonal shaped; a first formliner is configured to be assembled with a second formliner by overlaying at least a portion of an overlapping section of the second formliner onto at least a portion of an overlapped section of the first formliner such that an exterior surface of the overlapping section of the second formliner is flush with at least one exterior surface of a rib system of the first formliner; the at least one exterior surface of the rib system is configured to face the curable material in use; the rib system includes a plurality of non-overlap ribs; the rib system includes a transition zone between the internal ribs and the overlapped sections, the transition zone connecting the overlapped section with the non-overlap ribs; a first rib edge of the second formliner is positioned adjacent a transition zone of the first formliner when the first and second formliners are assembled together; the transition zone comprises a varying cross-sectional profile increasing from the overlapped section to the non-overlap ribs; the non-overlap ribs comprise overlapping sections of the rib system; the first and second formliners are configured to be connected with at least one other formliner, wherein the overlapped section comprises a cutout such that the overlapped section of the second formliner is not overlapped by an overlapping section of the at least one other formliner when the first, second, and at least one other formliners are assembled; the cutout is positioned at a corner of the formliner, the corner of the formliner formed by an intersection of ribs of the rib system; the cell is generally a rectangular shape; the formliner comprises a plurality of cells, wherein the rib system comprises a plurality of ribs, and wherein the plurality of ribs are disposed between the plurality of cells to form a plurality of boundaries of the cells; the plurality of cells define a generally rectangular shape; at least some of the plurality of cells are of different sizes; the plurality of cells comprise opposing ends, the plurality of cells being arranged in a plurality of rows with each row having at least two cells disposed end-to-end; cells of a first row of the plurality of rows are offset from cells of a second row of the plurality of rows; the formliner comprises a first end and a second end, the first end being formed to include a first finger joint pattern and the second end being formed to include a second finger joint pattern that is complementary to the first finger joint pattern, wherein a first end of the second formliner is configured to be overlaid with a second end of the first formliner; the contact surface comprises a textured pattern bounded by the rib system, wherein placing the curable material against the contact surface and the rib system forms a textured surface in an exposed surface of the curable material where the contact surface comprising the textured pattern directly contacts the exposed surface of the curable material; the textured pattern comprises at least one of brick, wood, rock, stone, faux stone, cut stone, sand stone, ledgestone, fieldstone, castle rock, river rock, or slate; and/or the textured pattern connects with the overlapped section to form the periphery.

According to this disclosure, a formliner for use in creating a decorative pattern on curable material includes one or more of the following: a cell having a contact surface; and a rib system including a plurality of ribs extending along the cell and forming at least a part of a boundary of the cell. The rib system includes one or more of the following: a first section connected with the cell and comprising a first rib end, the first section configured to face the curable material in use; and a second section connected with the cell and comprising a second rib end, at least a portion of the first section configured to overlay onto at least a portion of the second section. A perimeter is formed where the second section connects with the cell, the perimeter extending along the boundary of the cell. The first rib end extends along the boundary of the cell without contacting the perimeter of the cell when the at least a portion of the first section overlays onto the at least a portion of the second section. The second rib end extends adjacent to a lower portion of the first section when the at least a portion of the first section overlays onto the at least a portion of the second section.

According to this disclosure, the formliner further includes one or more of the following: the lower portion of the first section is between the first rib end and the cell; the first section comprises a first wall and a second wall connected with the first wall; the second section comprises a first wall, a second wall connected with the first wall of the second section, and a third wall connected with the second wall of the second section; the first wall of the first section is configured to overlap the third wall of the second section, and wherein the second wall of the first section is configured to overlap the second wall of the second section; the first wall of the first section comprises the lower portion of the first section; the second wall of the first section comprises the first rib end of the first section; the third wall of the second section comprises the second rib end of the second section; the first wall of the first section coupled with the second wall of the first section forms a generally L-shaped cross-sectional profile; the second wall of the second section connected to the first wall of the second section and the third wall of the second section connected to the second wall of the second section forms a generally C-shaped cross-sectional profile; the first rib end extends along a corner formed by the second wall of the second section connecting to the first wall of the second section when the at least a portion of the first section overlays onto the at least a portion of the second section; the first rib end is on the corner when the at least a portion of the first section overlays onto the at least a portion of the second section; the first section forms a first cross-sectional profile and the second section forms a second cross-sectional profile having a length, wherein the first cross-sectional profile is configured to overlap the second cross-sectional profile over about two-thirds of the length when the at least a portion of the first section overlays onto the at least a portion of the second section; the second section connects with the cell at the contact surface of the cell, wherein the perimeter is formed along the connection between the second section and the contact surface; at least some of the plurality of ribs are substantially polygonal shaped; a first formliner is configured to be connected with a second formliner by overlaying at least a portion of a first section of the second formliner onto at least a portion of a second section of the first formliner such that an exterior surface of the first section of the second formliner is flush with at least one exterior surface of a rib system of the first formliner, wherein the at least one exterior surface of the rib system is configured to face the curable material in use; the rib system includes a plurality of non-overlap ribs; the rib system includes a transition zone between the internal ribs and the second sections, the transition zone connecting the second section with the non-overlap ribs, and wherein a first rib end of the second formliner is positioned adjacent a transition zone of the first formliner when the first and second formliners are assembled together; the transition zone comprises a varying cross-sectional profile increasing from the second section to the non-overlap ribs; the non-overlap ribs comprise overlapping sections of the rib system; the first and second formliners are configured to be connected with at least one other formliner, wherein the second section comprises a cutout such that the second section of the second formliner is not overlapped by a first section of the at least one other formliner when the first, second, and at least one other formliners are assembled; the cutout is positioned at a corner of the formliner, the corner of the formliner formed by an intersection of ribs of the rib system; the cell is generally a rectangular shape; the formliner comprises a plurality of cells, and wherein the plurality of ribs are disposed between the plurality of cells to form a plurality of boundaries of the cells; the plurality of cells define a generally rectangular shape; at least some of the plurality of cells are of different sizes; the plurality of cells comprise opposing ends, the plurality of cells being arranged in a plurality of layers with each layer having at least two cells disposed end-to-end; cells of a first layer of the plurality of layers are offset from cells of a second layer of the plurality of layers; the formliner comprises a first end and a second end, the first end being formed to include a first finger joint pattern and the second end being formed to include a second finger joint pattern that is complementary to the first finger joint pattern, wherein a first end of the second formliner is configured to be overlaid with a second end of the first formliner; the contact surface comprises a textured pattern bounded by the rib system, wherein placing the curable material against the contact surface and the rib system forms a textured surface in an exposed surface of the curable material where the contact surface comprising the textured pattern directly contacts the exposed surface of the curable material; the textured pattern comprises at least one of brick, wood, rock, stone, faux stone, cut stone, sand stone, ledgestone, fieldstone, castle rock, river rock, or slate; and/or the textured pattern connects with the second section to form the perimeter.

According to this disclosure, a panel for forming a pattern on a surface includes one or more of the following: a plurality of cells defined by a bottom of the panel; a rib system comprising a plurality of ribs connected with the bottom of the panel, the plurality of cells configured for receiving material to form the pattern on the surface, the plurality of cells arranged in rows with at least some cells of each row being offset with respect to cells of an adjacent row; and a panel boundary bounding the plurality of cells. The panel boundary includes one or more of the following: a first section comprising a first rib end, the first section configured to face the curable material in use; and a second section comprising a second rib end, at least a portion of the second section configured to overlay onto at least a part of the second section. The second section connecting with the cell forms a periphery extending along a perimeter of the cell. The first rib end extends along the perimeter of the cell without contacting the periphery of the cell when the at least a portion of the overlapping section overlays onto the at least a portion of the overlapped section. The second rib end is configured to extend adjacent to an inner portion of the first section when the at least a portion of the first section overlays onto the at least a portion of the second section.

According to this disclosure, the panel further includes one or more of the following: the inner portion of the first section is between the first rib end and the cell; the first section comprises a first wall and a second wall coupled with the first wall; the second section comprises a first wall, a second wall coupled with the first wall of the second section, and a third wall coupled with the second wall of the second section, wherein the first wall of the first section is configured to overlap the third wall of the second section; the second wall of the first section is configured to overlap the second wall of the second section; the first wall of the first section comprises the inner portion of the first section; the second wall of the first section comprises the first rib end of the first section; the third wall of the second section comprises the second rib end of the second section; the first wall of the first section coupled with the second wall of the first section forms a generally L-shaped cross-sectional profile; the second wall of the second section connected to the first wall of the second section and the third wall of the second section connected to the second wall of the second section forms a generally C-shaped cross-sectional profile; the first rib end extends along a corner formed by the second wall of the second section connecting to the first wall of the second section when the at least a portion of the first section overlays onto the at least a portion of the second section; the first rib end is on the corner when the at least a portion of the first section overlays onto the at least a portion of the second section; the first section forms a first cross-sectional profile and the second section forms a second cross-sectional profile having a length, wherein the first cross-sectional profile is configured to overlap the second cross-sectional profile over about two-thirds of the length when the at least a portion of the first section overlays onto the at least a portion of the second section; the second section connects with the cell at the contact surface of the cell, wherein the periphery is formed along the connection between the second section and the contact surface; at least some of the plurality of ribs are substantially polygonal shaped; a first formliner is configured to be connected with a second formliner by overlaying at least a portion of a first section of the second formliner onto at least a portion of a second section of the first formliner such that an exterior surface of the first section of the second formliner is flush with at least one exterior surface of a rib system of the first formliner; the at least one exterior surface of the rib system is configured to face the curable material in use; the rib system includes a plurality of non-overlap rib sections; the rib system includes a transition zone between the second sections and the internal rib sections, the transition zone connecting the second section with the non-overlap rib section, and wherein a first rib end of the second formliner is positioned adjacent a transition zone of the first formliner when the first and second formliners are connected; the transition zone comprises a varying cross-sectional profile increasing from the second section to the non-overlap rib sections; the non-overlap rib sections comprise overlapping sections of the rib system; the first and second formliners are configured to be connected with at least one other formliner, wherein the second section comprises a cutout such that the second section of the second formliner is not overlapped by a first section of the at least one other formliner when the first, second, and at least one other formliners are assembled; the cutout is positioned at a corner of the formliner, the corner of the formliner formed by an intersection of the plurality of ribs of the rib system;

at least some of the plurality of cells have a generally rectangular shape; the plurality of ribs are disposed between the plurality of cells to form a plurality of the perimeters of the cells; the ribs are disposed between the cells to form a plurality of the perimeters of the cells; the plurality of cells define a generally rectangular shape; the cells define a generally rectangular shape; at least some of the plurality of cells are of different sizes; the plurality of cells comprise opposing ends, the plurality of cells being arranged in a plurality of layers with each layer having at least two cells disposed end-to-end; cells of a first layer of the plurality of layers are offset from cells of a second layer of the plurality of layers; the formliner comprises a first end and a second end, the first end being formed to include a first finger joint pattern and the second end being formed to include a second finger joint pattern that is complementary to the first finger joint pattern, wherein a first end of the second formliner is configured to be overlaid with a second end of the first formliner; the bottom of the panel comprises a textured pattern bounded by the rib system, wherein placing the curable material against the bottom of the panel and the rib system forms a textured surface in an exposed surface of the curable material where the bottom of the panel comprising the textured pattern directly contacts the exposed surface of the curable material; the textured pattern comprises at least one of brick, wood, rock, stone, faux stone, cut stone, sand stone, ledgestone, fieldstone, castle rock, river rock, or slate; and/or the textured pattern connects with the second section to form the periphery.

According to this disclosure, a first formliner for use in creating a decorative pattern on curable material includes one or more of the following: a generally planar rib network comprising a plurality of elongated ribs connected with each other; a plurality of generally planar base segments each connected with at least a subset of the plurality of elongated ribs along a perimeter of the respective base segment; each base segment and the subset of ribs connected thereto define a cell therein; an L section of the plurality of elongated ribs extending along a first portion of a boundary of the first formliner; and a C section of the plurality of elongated ribs extending along a second portion of the boundary of the first formliner. The L section has a cross-sectional shape including one or more of the following: a first wall having a first end and a second end opposite the first end, the first end connected to a first base segment within a lower region of the L section, and the first wall extending generally perpendicularly from the first base segment; and a second wall having a first end and a free end opposite the first end, the first end of the second wall connected to the second end of the first wall, and the second wall extending generally perpendicularly from the first wall. The C section has a cross-sectional shape including one or more of the following: a first wall having a first end and a second end opposite the first end, the first end connected to a second base segment, and the first wall extending generally perpendicularly from the second base segment; a second wall having a first end and a second end opposite the first end, the first end of the second wall connected to the second end of the first wall, and the second wall extending generally perpendicularly from the first wall; and a third wall having a first end and a free end opposite the first end, the first end of the third wall connected to the second end of the second wall, and the third wall extending generally perpendicularly from the second wall. The L section of the first formliner defines a space configured to receive therein a C section of a second formliner such that a third wall of the C section of the second formliner extends toward the lower region of the L section of the first formliner. The C section of the first formliner is configured to be received by an L section of a third formliner such that the third wall of the C section of the first formliner extends toward a lower region of the L section of the third formliner.

According to this disclosure, the first formliner further includes one or more of the following: the L section of the first formliner is further configured such that, when the L section of the first formliner receives the C section of the second formliner, the free end of the L section does not extend beyond a first wall of the C section of the second formliner; the L section of the first formliner is further configured such that, when the L section of the first formliner receives the C section of the second formliner, the free end of the L section does not extend into a cell of the second formliner; the L section of the first formliner is further configured such that, when the L section of the first formliner receives the C section of the second formliner, the free end of the L section of the first formliner ends in a plane extending along the first wall of the C section of the second formliner; the L section of the first formliner is further configured such that, when the L section of the first formliner receives the C section of the second formliner, the free end of the L section of the first formliner is coextensive with an inner surface of the second end of the first wall of the C section of the second formliner; the C section of the first formliner is further configured such that, when the C section of the first formliner is received by the L section of the third formliner, the free end of the C section is located closer to the second end of the first wall of the L section of the third formliner than to the first end; the C section of the first formliner is further configured such that, when the C section of the first formliner is received by the L section of the third formliner, the free end of the C section is located about halfway between the first and second ends of the first wall of the L section of the third formliner; the C section of the first formliner is further configured such that, when the C section of the first formliner is received by the L section of the third formliner, the free end of the C section is located closer to the first end of the first wall of the L section of the third formliner than to the second end; the C section of the first formliner is further configured such that, when the C section of the first formliner is received by the L section of the third formliner, the free end of the C section is adjacent the lower region of the L section of the third formliner; the C section of the first formliner is further configured such that, when the C section of the first formliner is received by the L section of the third formliner, the free end of the C section does not extend beyond the first end of the first wall of the L section of the third formliner; the C section of the first formliner is further configured such that, when the C section of the first formliner is received by the L section of the third formliner, the free end of the C section is coplanar with a bottom surface of the base segment of the third formliner to which the first wall of the L section of the third formliner is connected; the C section of the first formliner is further configured such that, when the C section of the first formliner is received by the L section of the third formliner, the free end of the C section is coextensive with the first end of the first wall of the L section of the third formliner; an internal section of the plurality of elongated ribs extending between the L and C sections and connecting adjacent base segments, the internal section comprising first and second walls connected to and extending generally perpendicularly from the adjacent base segments, the first and second walls of the internal section connected therebetween by a bridge; the bridge is generally coplanar with the second wall of the L section; the bridge is noncoplanar with the second wall of the C section; the bridge is located farther from the base segments than the second wall of the C section; a transition zone connecting each internal section with the adjacent respective C section; the transition zone comprises a step; the transition zone comprises a vertical step; when the L section of the first formliner receives the C section of the second formliner, the free end of the L section of the first formliner is received by the transition zone of the second formliner; when the C section of the first formliner is received by the L section of the third formliner, the transition zone of the first formliner receives the free end of the L section of the third formliner; and/or a continuous surface is formed at the transition zone of the first formliner when the first formliner is assembled with an other formliner.

According to this disclosure, a formliner for use with a framework to create a decorative pattern on curable material includes one or more of the following: a cell comprising a base configured to face the curable material in use, wherein the base extends along the framework and at least a part of the base contacts the framework when the formliner is in use with the framework, wherein the framework is configured to support the formliner in a desired position; and a rib system extending along the cell and forming at least a part of a boundary of the cell. The rib system includes one or more of the following: an overlapping section comprising a first rib edge, the overlapping section configured to face the curable material in use; and an overlapped section comprising a second rib edge, at least a portion the overlapping section configured to overlay onto at least a portion of the overlapped section. The overlapped section connecting with the cell forms an inner periphery extending generally along the boundary of the cell and extending generally along the framework when the formliner is in use with the framework. A first formliner is configured to be coupled to a second formliner by overlaying at least a portion of an overlapping section of a rib system of the second formliner onto at least a portion an overlapped section of a rib system of the first formliner. When the first and second formliners are coupled, a first rib edge of the overlapping section of the second formliner extends along a boundary of a cell of the first formliner without contacting an inner periphery of the cell of the first formliner. When the first and second formliners are coupled, a second rib edge of the overlapped section of the first formliner extends along the boundary of the cell of the first formliner, the second rib edge of the first formliner extending toward the framework to be in contact with the framework such that the second rib edge of the first formliner provides structural support to the overlapped section of the first formliner and the overlapping section of the second formliner when the first and second formliners are in use with the framework.

According to this disclosure, a formliner for use in creating a decorative pattern on curable material includes one or more of the following: a cell comprising a base configured to face the curable material in use; and a rib system extending along the cell. The rib system includes one or more of the following: a first wall extending upwardly from the base; a second wall extending from first wall substantially in parallel with an extent of the base; a third wall extending downwardly from the second wall toward the extent of the base; and a fourth wall extending upwardly from the base; a fifth wall extending from fourth wall substantially in parallel with the extent of the base. The fifth wall is configured to overlap the second wall.

According to this disclosure, the formliner further includes one or more of the following: the fifth wall has a length substantially equal to an extent of the second wall, the extent of the second wall substantially parallel to the extent of the base; the fifth wall extends from the fourth wall substantially to an edge formed by the second wall connecting to the first wall when the fifth wall is overlapped with the second wall; the third wall has a length substantially equal to an extent of the fourth wall, the extent of the fourth wall substantially perpendicular to the extent of the base; the third wall extends from the second wall substantially to an edge formed by the fourth wall connecting to the base of the cell when the fifth wall is overlapped with the second wall; the third wall extends adjacent to the fourth wall when the fifth wall is overlapped with the second wall; walls of the rib system form one or more polygonal shapes; the formliner comprises a plurality of cells, wherein the rib system comprises a plurality of ribs, and wherein the plurality of ribs are disposed between the plurality of cells to form a plurality of boundaries of the cells; the plurality of cells define a generally rectangular shape; the cells define a generally rectangular shape; at least some of the plurality of cells are of different sizes; the plurality of cells comprise opposing ends, the plurality of cells being arranged in a plurality of rows with each row having at least two cells disposed end-to-end; cells of a first row of the plurality of rows are offset from cells of a second row of the plurality of rows; the formliner comprises a first end and a second end, the first end being formed to include a first finger joint pattern and the second end being formed to include a second finger joint pattern that is complementary to the first finger joint pattern, wherein a first end of the second formliner is configured to be overlaid with a second end of the first formliner; the base comprises a textured pattern bounded by the rib system, wherein placing the curable material against the base and the rib system forms a textured surface in an exposed surface of the curable material where the contact surface comprising the textured pattern directly contacts the exposed surface of the curable material; the textured pattern comprises at least one of brick, wood, rock, stone, faux stone, cut stone, sand stone, ledgestone, fieldstone, castle rock, river rock, or slate; the textured pattern connects with the first wall and the fourth wall; and/or the first wall, the fourth wall, and the fifth wall are configured to face the curable material in use when the fifth wall is overlapped with the second wall.

According to this disclosure, a method for assembling formliners includes one or more of the following: connecting a first formliner with a second formliner by overlaying at least a portion of an overlapping section of a rib of the second formliner onto at least a portion of an overlapped section of a rib of the first formliner, the overlapping section of the rib of the second formliner configured to face curable material; while connecting the first formliner with the second formliner, positioning at least a portion of a first rib edge of the overlapping section of the rib of the second formliner such that the first rib edge extends along a boundary of a cell without contacting an inner periphery of the cell; the inner periphery formed where the overlapped section connects with the base of the cell; the inner periphery extending generally along the boundary of the cell; a rib system comprising a plurality of ribs extending along the cell and forming at least a part of the boundary of the cell; and/or the cell of the first formliner configured to face curable material in use and comprising a decorative pattern to be created in the curable material.

According to this disclosure, the method further includes one or more of the following: positioning a second rib edge of the rib of the first formliner against a support surface to provide structural support to the overlapped section of the first formliner and the overlapping section of the second formliner; placing the curable material against exterior surfaces of the first and second formliners to create the decorative pattern in the curable material; positioning the first rib edge of the overlapping section of the rib of the second formliner adjacent to a transition zone of the rib of the first formliner, the transition zone having a varying profile that connects the overlapped section of the rib of the first formliner with a non-overlap section of the rib of the first formliner, wherein the non-overlap section of the rib of the first formliner is not overlapped by the overlapping section of the rib of the second formliner; while connecting the first formliner with the second formliner, further comprising positioning a part of the rib of the second formliner over a cutout in the overlapped section or the overlapping section of the rib of the first formliner such that the part of the rib of the second formliner does not overlap the rib of the first formliner; connecting the first and second formliners with at least one other formliner by overlaying at least a portion of an overlapping section of a rib of the at least one other formliner onto at least an other portion of the overlapped section of the rib of the first formliner; while connecting the first, second, and at least one other formliners, positioning at least a portion of a first rib edge of the overlapping section of the rib of the at least one other formliner such that the first rib edge extends along the boundary of a cell without contacting the inner periphery of the cell; connecting the first, second, and at least one other formliners with a fourth formliner by overlaying at least a portion of an overlapping section of a rib of the fourth formliner onto at least a further other portion of the overlapped section of the first formliner; while connecting the first, second, at least one other, and fourth formliners, positioning at least a portion of a first rib edge of the overlapping section of the rib of the fourth formliner such that the first rib edge extends along the boundary of a cell without contacting the inner periphery of the cell; while connecting the first, second, at least one other, and fourth formliners, positioning at least an other portion of the first rib edge of the overlapping section of the rib of the fourth formliner into such that the first rib edge extends along the boundary of a cell without contacting the inner periphery of the cell, the inner periphery of the second formliner extending between the rib of the second formliner and a cell of the second formliner, the cell of the second formliner configured to face the curable material and comprising the decorative pattern to be created in the curable material; while connecting the first, second, at least one other, and fourth formliners, positioning at least a further portion of the first rib edge of the overlapping section of the rib of the fourth formliner such that the first rib edge extends along a boundary of a cell of the at least one other formliner without contacting an inner periphery of the cell, the inner periphery of the at least one other formliner extending between the rib of the at least one other formliner and a cell of the at least one other formliner, the cell of the at least one other formliner configured to face the curable material and comprising the decorative pattern to be created in the curable material; and/or while connecting the first, second, at least one other, and fourth formliners, positioning a part of the overlapping section of the rib of the fourth formliner onto a cutout in the overlapping section or the overlapped section of the rib of the at least one other formliner such that the part of the overlapping section of the rib of the fourth formliner directly faces the overlapped section of the first formliner.

Moreover, the method can also comprise the step of engaging a third formliner with the first formliner and the second formliner. The third formliner can comprise overlapping ridges and overlapped ridges, and one of the first, second, or third formliner comprising a sub-overlapped ridge section. The sub-overlapped ridge section can define an exterior geometry that can be less than an interior geometry of the overlapped ridges. In this regard, the method can further comprise overlaying an overlapped ridge onto the sub-overlapped ridge section. Additionally, the sub-overlapped ridge section can be formed along a corner of a boundary of the first formliner, and the method can comprise overlaying the second formliner and the third formliner onto the first formliner at the sub-overlapped ridge section of the first formliner.

BRIEF DESCRIPTION OF THE DRAWINGS

Non-limiting and non-exhaustive features will be described with reference to the following figures, wherein like reference numerals refer to like parts throughout the various figures, unless otherwise specified.

DETAILED DESCRIPTION

Figure 1A:
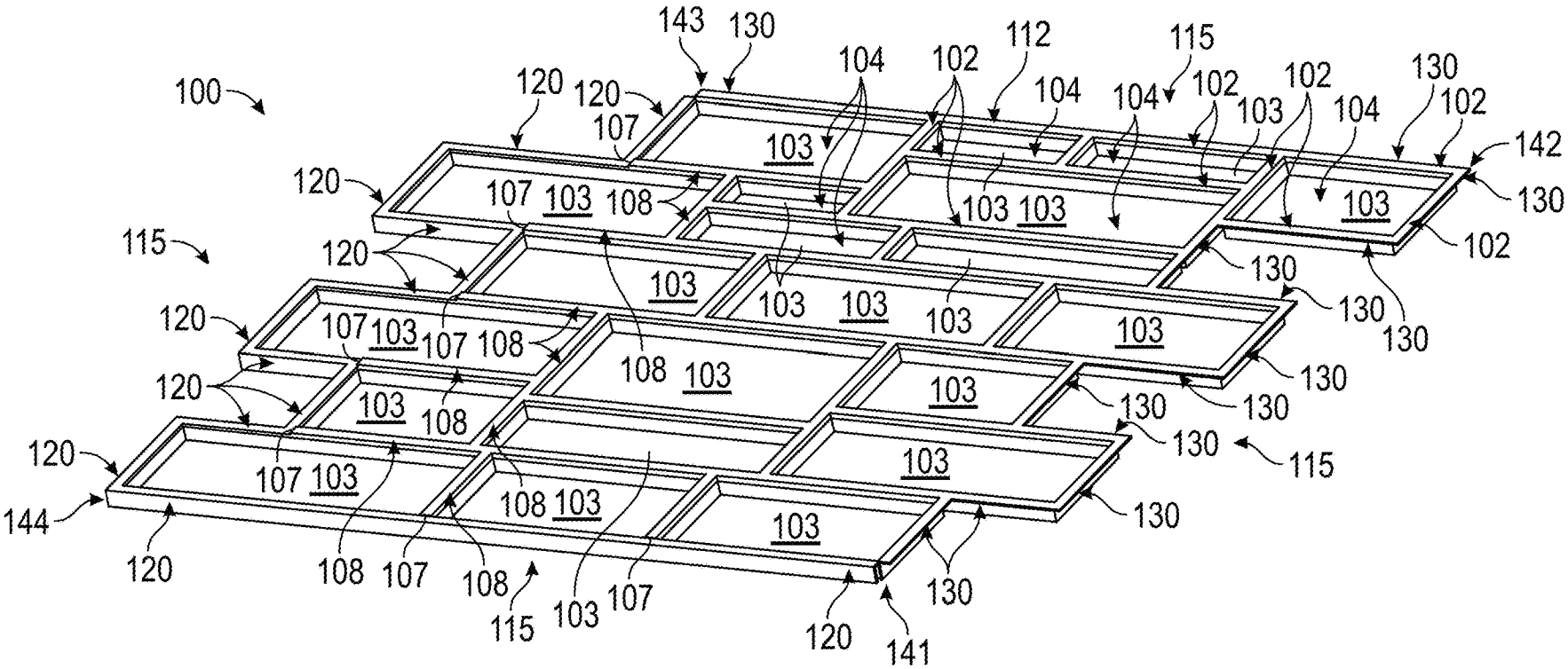
FIGS. 1A-1B are top perspective views of a formliner.

While the present description sets forth specific details of various features, it will be appreciated that the description is illustrative only and should not be construed in any way as limiting. Furthermore, various applications of such features and modifications thereto, which may occur to those who are skilled in the art, are also encompassed by the general concepts described herein.

As generally discussed above, formliners of the present inventions are advantageously configured in order to enhance the aesthetic finish of a concrete structure. In particular, formliners disclosed herein can be used to create a natural, seamless appearance of brick, stone, and other types of materials in a concrete structure.

In contrast to prior art formliners that produce an inferior quality product, the structures of the formliner disclosed herein, which can also be referred to as a panel or sheet, allow the formliner to create decorative patterns that are visually superior to results provided through the prior art. These significant advantages are due at least in part to the nesting arrangement of the variable size channels of the formliner disclosed herein such as, for example, various parts of the formliner having corresponding features or parts (e.g., channels) that can mate, connect, or overlay with each other to form a desired formliner assembly. In particular, the formliner can comprise one or more relatively larger interconnection sections and one or more relatively smaller interconnection sections such that a plurality of formliners can be interconnected at their respective large and small interconnection sections. When interconnected, the plurality of formliners can define one or more generally continuous dimensions or shapes of raise portions thereof. For example, the large and small interconnection sections can be configured as nesting semi-cylinders or semi-polygons (e.g., polygons not closed on one or more sides) that form a rib structure. Additional advantages and features of the formliner are discussed further below.

It is contemplated that the formliner can be attached to another formliner and/or a form work by means of an adhesive. The adhesive can be disposed on a rear surface or back of the formliner and/or onto a front surface of the formliner. For example, the adhesive can be disposed on the front surface along a rib or ridge that will be overlaid by a portion of another formliner. The adhesive can be applied to butt-ends of formliners (e.g., sections that do not overlap as discussed herein).

The adhesive can be applied to the formliner at the site. For example, the adhesive can be applied or sprayed onto the formliner. The formliner can comprise an adhesive that can be activated or exposed in order to enable adhesive attachment of the formliner to another formliner or to a form work. The adhesive can be pre-applied to the formliner and can be exposed by removing a cover strip or activated by dampening with a liquid such as water or otherwise. As such, by peeling away a cover strip or by providing moisture to the adhesive, the adhesive can be activated to adhesively attach the formliner to another formliner or to a form work. As noted above in this manner, the formliner can be securely attached to another formliner in a pattern and/or to a form work to facilitate handling and placement of the formliner.

The formliner and formliner components disclosed herein can be manufactured using any of a variety of processes. For example, it is contemplated that some formliners can be formed using a sheet and a vacuum forming operation. Other manufacturing processes such as injection molding, stamping, extrusion, etc. can also be used.

Figure 1B:
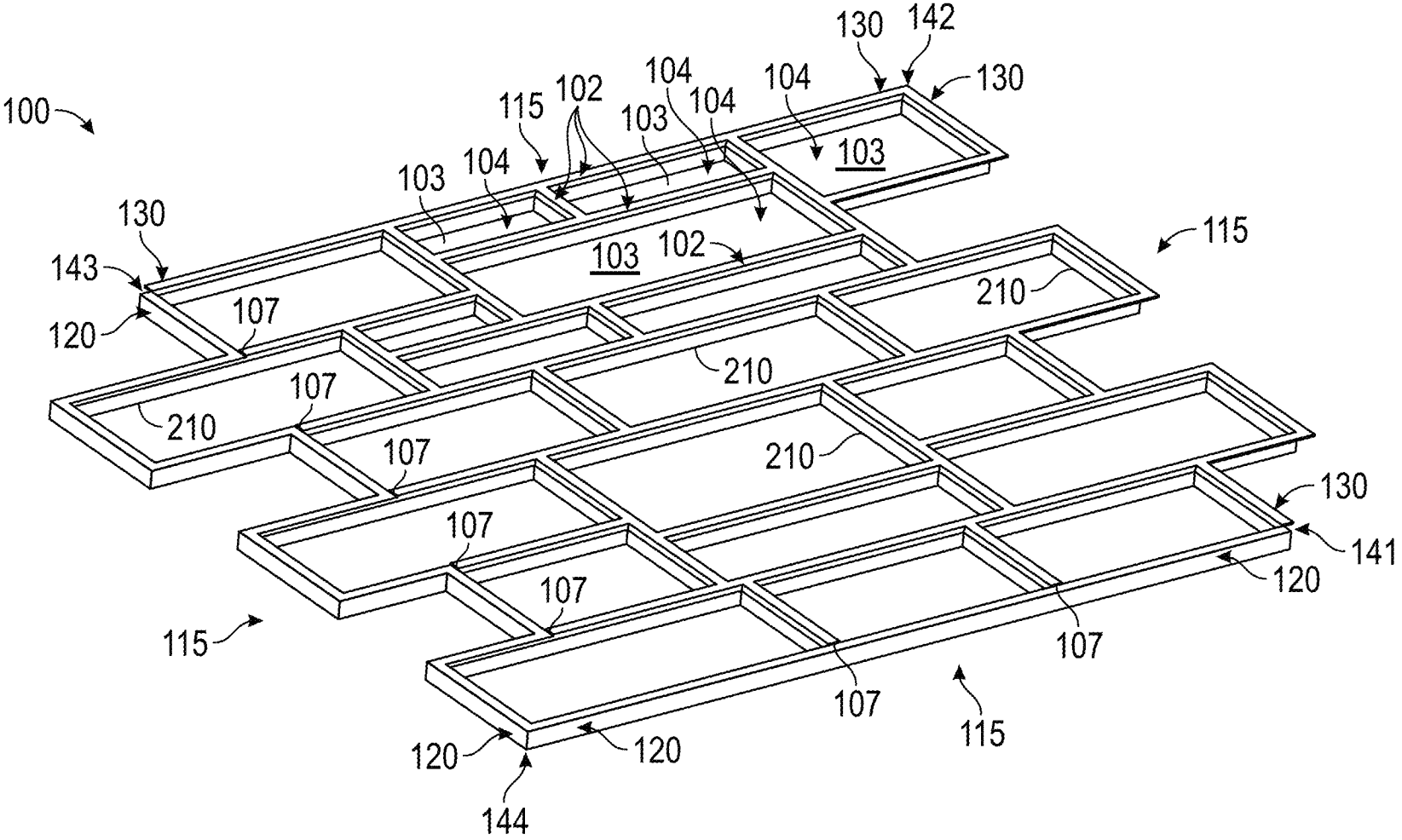

FIG. 1A is a top perspective view of a panel, sheet, or formliner 100 from one side of the formliner 100, while FIG. 1B is a top perspective view of the formliner 100 from the opposite side of the formliner 100. Referring to FIGS. 1A and 1B, the formliner 100 can comprise a plurality of channels, ridges, or ribs 102. The ribs 102 can be a raised portion of the formliner 100. The ribs 102 can define an outer perimeter of the formliner 100. Additionally, the ribs 102 can extend inwardly to form one or more recesses or cells 104.

The cells 104 can comprise a recessed portion of the formliner 100. The recessed portion of the cell 104 can be configured to receive a curable material to which a pattern of the formliner can be conferred or transferred. The cells 104 can be uniformly sized. For example, the cells 104 can be rectangularly shaped. As discussed below, the formliner 100 can implement other shapes, depths, and sizes of the cells 104.

As shown, the cells or recesses 104 can be arranged in rows or layers. As will be discussed further below, the cells or recesses 104 of a given row can be offset with respect to cells or recesses of an adjacent or neighboring row. In this regard, a plurality of formliners 100 can be interconnected along ends thereof in such a way as to reduce any visible appearance of a seam between interconnected formliners. The offset configuration of the cells or recesses 104 can aid in concealing or hiding any seaming between formliners as well as provide a corresponding assembly joints for the formliners that conform to a desired pattern (e.g., rectangular cells 104).

Additionally, the cells 104 of adjacent rows can be offset from each other such that at opposing ends of the formliner 100, some of the cells 104 protrude at the end. In this regard, the rows can be formed to include projecting and non-projecting cells 104. The projecting cells can be considered to be complete or whole cells. In other words, the projecting cells may not be smaller in size than other cells 104 of the pattern even though the offset configuration of the cells 104 causes the projecting cells to protrude at one side or end of the formliner 100. As will be discussed further below, the projecting cells of the pattern can be interconnected with projecting cells of another formliner.

The formliner 100 can be used to create a faux brick pattern on a concrete structure. The formliner 100 can define a panel boundary 115 bounding the plurality of cells 104 by a plurality of sides. The top side of the formliner 100 may be positioned such that it can be pressed into fresh concrete. This can be accomplished by placing the formliner 100 against an exposed surface of fresh concrete. Otherwise, this can be accomplished by affixing a lower surface of the formliner 100 to an interior wall of a pattern, casting, or formwork (e.g., framework) before concrete is poured into the pattern, casting, or formwork. In either case, a material, such as concrete can be placed against the decorative pattern of the formliner 100 defined by the ribs 102 and the cells 104 in order to transfer the decorative pattern to the exposed surface of the material as the material cures.

The formliner 100 may include one or more ribs 102 that together form a rib system or network. The ribs 102 may be connected to or otherwise coupled with, and extend or project away from, one or more base segments or base 103 (e.g., web, contact surface, plane, base plane). The base 103 may be generally flat or planar with the ribs 102 projecting from a side of the base 103. The ribs 102 connecting with the base 103 may form perimeters or peripheries 210 of the cells 104 (e.g., inside a cell 104) as discussed herein and in particular, in reference to FIG. 2B. The base 103 can have an extent along the cell 104. For example, the extent of the base 103 may be substantially perpendicular to the walls of the ribs as discussed herein. The extent of the base 103 may be along a longitudinal dimension of the base 103. For example, the extent of the base 103 may be the length between two peripheries 210 illustrated in FIG. 2B.

The base 103 can have a desired textured pattern as discussed herein. The ribs 102 form a rib system 112 of the formliner 100. The rib system 112 and the base 103 can define or form a cell 104. There may be one or more cells 104. As shown, there are twenty-one cells 104. However, there may be fewer or more cells 104. The cells 104 may be spaces into which a curable material, such as concrete, may be poured. It is understood that not every instance of a feature of the formliner is labeled in the various figures. For example, only some of the cells 104 are labeled in FIGS. 1A-1B, however it is understood that there are other cells 104 as illustrated that, for purposes of clarity, are not labeled. Similarly, only some of the ribs 102 are labeled in FIGS. 1A-1B for clarity. This may be true for other features of the formliner in this or other figures where fewer than all of those features shown in the respective figures are labeled with callouts.

The ribs 102 may have varying shapes, sizes and configurations. As shown, the ribs 102 extend along and form a boundary 115 of the formliner 100 as well as a boundary 115 for the cells 104. The boundary 115 may be located generally on the sides of the formliner 100. The ribs 102 that form the boundary 115 may include one or more overlapped sections 120 (e.g., second sections) and one or more overlapping sections 130 (e.g., first sections). As shown, the overlapped section 120 extends along two adjacent portions of the boundary 115, while the overlapping section 130 extends along the two other adjacent portions of the boundary 115, as further described below. The overlapped sections 120 and the overlapping sections 130 may have various configurations as discussed in further detail herein, for example with respect to FIGS. 4A-4C. As further discussed, the configurations of the sections 120, 130 may allow for a first formliner 100 to meet or otherwise couple with complementary portions of a second formliner 100. Further detail of the coupling of multiple formliners together is discussed herein, for example with respect to FIGS. 3A-6.

The formliner 100 may have corners. As shown, the formliner may have a first corner 141, a second corner 142, a third corner 143 and a fourth corner 144. The four corners 141, 142, 143, 144 may also be located at or along the boundary 115. The four corners 141, 142, 143, 144 may be located at the ends of respective overlapped sections 120 and/or overlapping sections 130. As shown, the overlapping section 130 may extend along and form the boundary 115 from the first corner 141 to the second corner 142. As further shown, the overlapping section 130 may extend along and form the boundary 115 from the second corner 142 to the third corner 143. The overlapped section 120 may extend along and form the boundary 115 from the third corner 143 to the fourth corner of 144. As further shown, the overlapped section 120 may extend along and form the boundary 115 from the fourth corner 144 to the first corner 141.

The boundary 115 and the various sections or portions thereof may extend in a variety of directions and have a variety of contours. As shown, the overlapping section 130 extending from the first corner 141 to the second corner 142 may be in a first finger joint pattern. Similarly, the overlapped section 120 extending from the third corner 143 to the fourth corner 144 may be in a second finger joint pattern as shown that is opposite from and complementary to the first finger joint pattern. The complementary boundary portions, whether finger joint or other patterns or contours, may allow two or more formliners to be seamlessly assembled together. The boundary 115 may also be straight. As shown, the overlapping section 130 may extend from the second corner 142 to the third corner 143 in a generally straight or unbent fashion without any turns, bends, or corners. The overlapped section 120 may extend from the fourth corner 144 to the first corner 141 in a similarly straight manner as shown.

The various corners 141, 142, 143, 144 of the formliner 100 may be locations where the various sections intersect or are otherwise adjacent to each other. As shown, the first corner 141 may be at a location where the overlapped section 120 intersects with or otherwise approaches the overlapping section 130. The second corner 142 may be at a location where one overlapping section 130 intersects with or otherwise approaches another overlapping section 130. The third corner 143 may be a location where the overlapping section 130 intersects with or otherwise approaches the overlapped section 120. The fourth corner 144 may be a location where the overlapped section 120 intersects with or otherwise approaches another overlapped section 120.

The ribs 102 extending along and forming the boundary 115 of the formliner 100 may therefore include the overlapped or overlapping sections 120, 130. However, the ribs 102 along the boundary 115 need not include entirely either an overlapped section 120 or an overlapping section 130. The ribs 102 forming the boundary 115 may include discontinuities therealong. Thus, the formliner shown in FIGS. 1A-1B is merely one configuration that is possible, and other suitable configurations are within the scope of this disclosure.

The ribs 102 may also include one or more internal sections 108 (e.g., internal ribs, non-overlap ribs). As shown, the internal sections 108 may be portions or segments of the ribs 102 other than those portions along the boundary 115 of the formliner 100. The internal sections 108 may be portions of the ribs 102 that extend or project farther from the base 103 than other portions of the ribs 102. For example, the internal sections 108 may project farther from the base 103 than the overlapped sections 120. Further, the overlapping sections 130 may be at a similar height as the internal sections 108. For example, as shown, the internal sections 108 may extend to and interface with the overlapping sections 130. Portions of the internal sections 108 and portions of the overlapping sections 130 may thus be at the same height or have the same length from the base 103. Portions of the internal sections 108 and portions of the overlapping sections 130 may thus be at the same height relative to the base 103. Further detail of the heights and cross-sections of the various sections 108, 120, 130 of the ribs 102 are discussed herein, for example with respect to FIGS. 2A-2D.

The cells 104 may have a perimeter or periphery formed by various portions or sections of the ribs 102 (e.g., connections or connecting areas/points between the ribs 102 and the cells 104). The perimeter of the cells 104 may include, as shown, the internal section 108, the overlapped section 120, and/or the overlapping section 130. Further, the perimeter of the cells 104 may include one or more sides that extend along the boundary 115. For example, the cell 104 adjacent the second corner 142 includes a perimeter with three sides along the boundary 115. Similarly, the cell 104 adjacent the first corner 141 includes a perimeter with two sides along the boundary 115. Similarly, the cell 104 adjacent the third corner 143 includes a perimeter with two sides along the boundary 115, which may include, as shown, part of the overlapped section 120 and part of the overlapping section 130. Similarly, as shown, the cell 104 adjacent the fourth corner 144 may have a perimeter with two sides along the boundary and part of a third side along the boundary 115, which may include, as shown, portions of the overlapped section 120.

The cells 104 may therefore be formed by various portions or sections of the ribs 102 and the base 103. For example, some of the cells 104 may be formed by the overlapped section 120 and the internal section 108 of the ribs 102. Further, as shown, some of the cells 104 may be formed entirely by the internal sections 108 of the ribs 102. Further, the cells 104 may be formed by the overlapping sections 130 and the internal sections 108 of the ribs 102. Therefore, various portions and sections of the ribs 102 along with the base 103 may form the cells 104.

The cells 104 may also have various shapes and sizes. As shown, the cells 104 may be generally rectangular in shape and of various sizes. However, some of the cells 104 may have the same size and/or shape. Further, other shapes besides rectangular may be implemented, such as square, triangular, polygonal, rounded, other shapes, and/or combinations thereof. Thus, the configuration shown of the cells 104 is merely one example and many other suitable configurations are possible.

The formliner 100 may include one or more transition zones 107. As shown, there may be seven transition zones 107. There may be fewer or more than seven transition zones 107, such as one, two, three, four, five, six, eight, nine, ten, fifteen, twenty, fifty, one hundred, or more. The transition zones 107 may be a portion or segment of one or more ribs 102 with transitions between various sections or portions of the ribs 102. For example, as shown, the transition zones 107 may provide a transition between the overlapped sections 120 and the internal sections 108 of the ribs 102. Further, as shown, the transition zones 107 may be located at or near the boundary 115 of the formliner 100. The transition zones 107 may be changes in height or other features of the various sections of the ribs 102, as discussed in further detail herein, for example with respect to FIG. 4C.

Figure 1C:
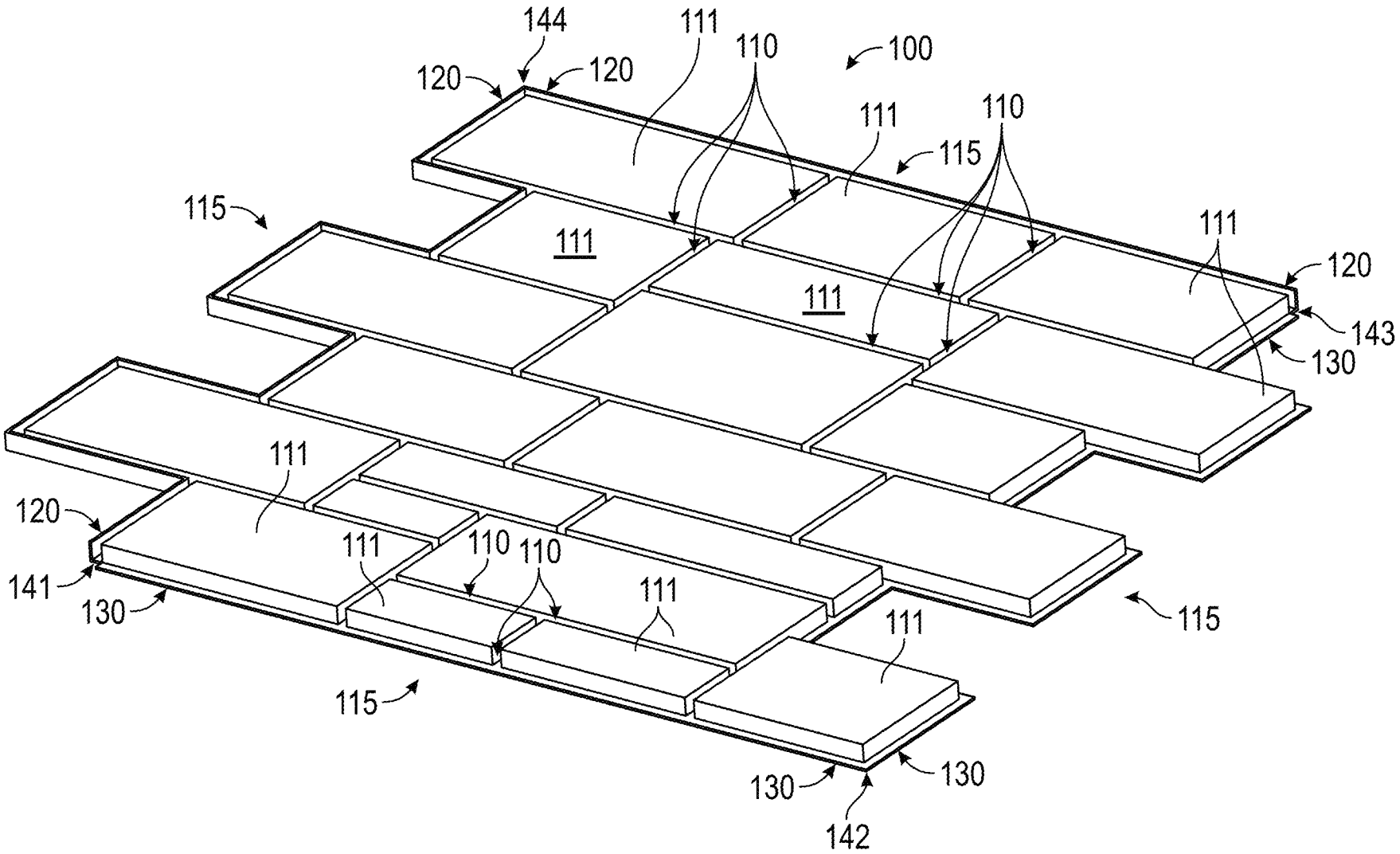
FIGS. 1C-1D are bottom perspective views of the formliner of FIGS. 1A-1B.
Figure 1D:
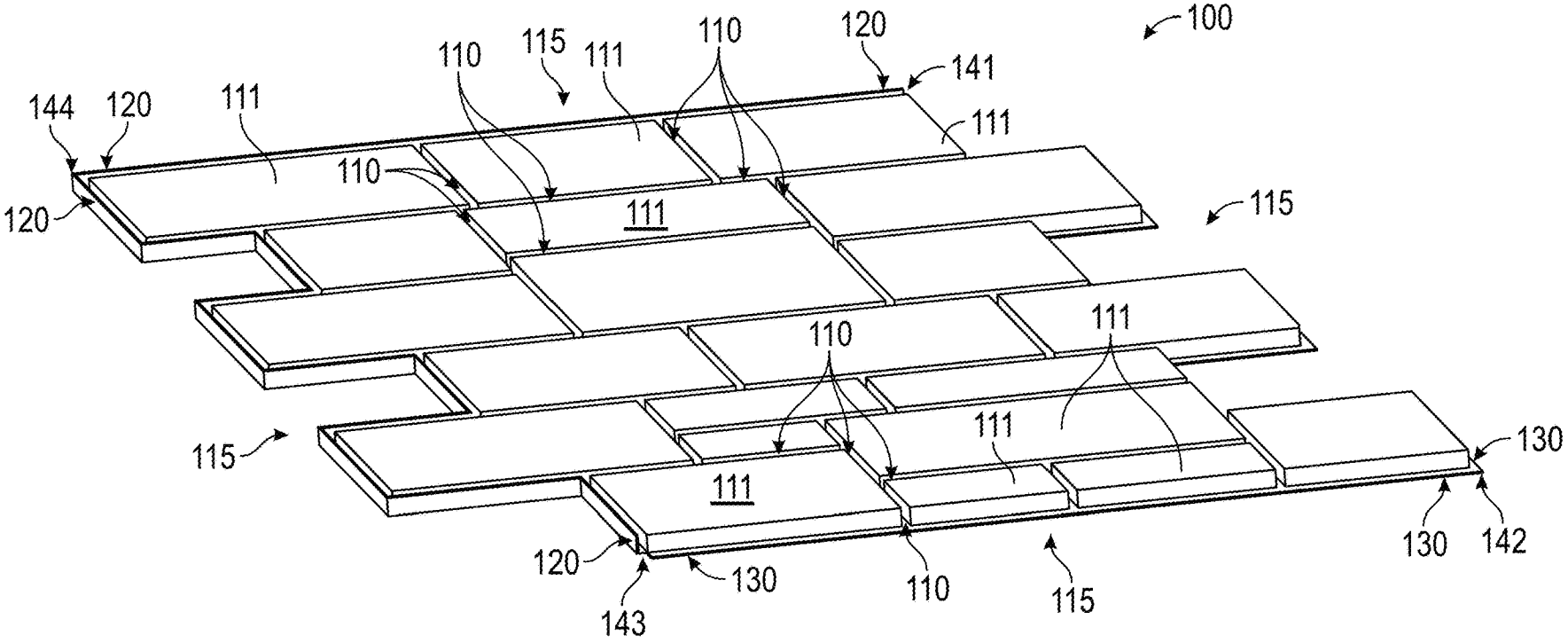

FIGS. 1C and 1D are bottom perspective views of the formliner 100. FIG. 1C is a bottom perspective view from one side of the formliner 100, and FIG. 1D is a bottom perspective view from the opposite side of the formliner 100. As shown, the bottom side of the formliner 100 may include one or more bottom surfaces 111 (e.g., web, base, lower surface, etc.). The bottom surfaces 111 may be surfaces of the base 103 that are located opposite from the interior of the cell 104.

The bottom side of the formliner 100 may include one or more channels 110. The channels 110 may be spacings, which may be empty spaces or voids or may be filled with material, in between the various cells 104. As shown, the channels 110 may be empty spaces on the underside of the ribs 102. The channels 110 may be formed during the manufacturing process. The channels 110 may be formed from a mold that is used to create the cells 104 of the formliner 100. The mold includes projections in the shape of the cells 104 where the projections are spaced so that the channels 110 form in the formliner 100 in between the cells when produced with the mold. While the channels 110 may be spaces in between the cells 104, the channels 110 may be filled with material. Therefore, the channels 110 may be solid portions of the formliner 100 in between the cells 104. The channels 110 may also be spaces or materials within the ribs 102. For example, the ribs 102 shown in FIGS. 1A and 1B may form the channels 110 on the underside (as oriented in FIGS. 1A and 1B) of the ribs 102.

Figure 1E:
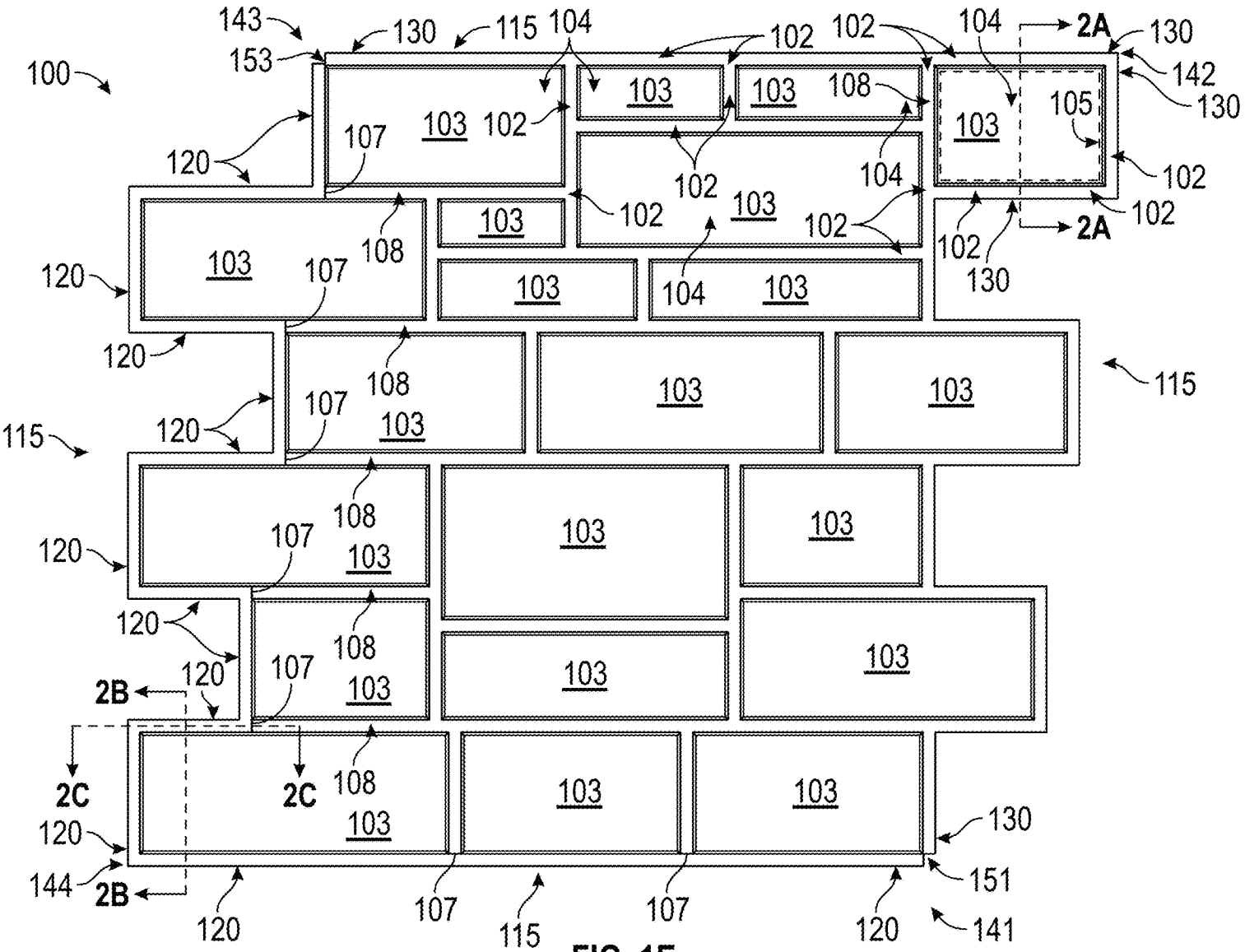
FIG. 1E is a top view of the formliner of FIGS. 1A-1B.

FIG. 1E is a top view of the formliner 100. As shown, the formliner may include various rows or layers of the cells 104 extending from left to right as oriented in the figure. The rows of the cells 104 may be aligned with each other or they may be unaligned. Further, the rows may be complete or incomplete. Therefore, various configurations of the cells 104 may be implemented.

As mentioned, the cells 104 may have a perimeter that is formed by various ribs 102. Further, the cells 104 may define or form a cell space or volume 105. As shown, the cell 104 adjacent the second corner 142, or other cells, may include a cell volume 105 that extends to the surrounding four ribs 102 of the cell 104. In the cell 104 adjacent the second corner 142, the cell volume 105 extends between three overlapping sections 130 of the ribs 102 and one internal section 108 of the ribs 102. The cell volume 105 is shown in dashed lines, indicating that it is merely a geometric reference and not a physical feature of the formliner 100. Further, the dashed lines are shown offset from the surrounding ribs 102 for purposes of clarity. It is understood that the cell volume 105 may extend to the inner surfaces of the surrounding ribs 102. The cell volume 105 may therefore have a depth, which is shown and explained in further detail herein, for example with respect to FIG. 2A. Further, while a single cell 104 has been used to describe the cell volume 105, it is understood that any of the other cells 104 may also form or define other cell volumes 105.

Further shown in FIG. 1E is the boundary 115. As mentioned, the boundary 115 extends along the outer perimeter of the formliner 100. Further, the boundary 115 may have a variety of contours besides those shown and described elsewhere herein. For instance, in FIG. 1E, the segment of the boundary 115 between the first corner 141 and the second corner 142 includes inner portions that are aligned with each other and outer portions that are not aligned with each other. As shown, along a direction from the first corner 141 to the second corner 142, the outer portions of this segment of the boundary 115 may extend progressively farther outward (to the right as oriented). This is in contrast to the segment of the boundary 115 on the opposite side of the formliner 100. This opposite segment of the boundary 115, extending from the fourth corner 144 to the third corner 143, includes outer portions of the boundary that are aligned and inner portions that are not aligned. As shown, along a direction from the fourth corner 144 to the third corner 143, the inner portions of this segment of the boundary 115 are located progressively farther inward. These two opposite segments of the boundary 115 are therefore complementary such that two of the formliners 100 may be coupled or paired together. Such assemblies are discussed in further detail herein, for example with respect to FIGS. 3A-6.

For purposes of the present discussion, it is understood that other complementary configurations of opposite segments of the boundary 115 may be embodied. The portion of the boundary 115, going in the direction from the first corner 141 to the second corner 142, may be located progressively farther inward. Further, the inner portions of this segment of the boundary 115 need not be aligned with each other but may be offset or located progressively farther inward or outward, or combinations thereof, in the direction from the first corner 141 to the second corner 142. Similarly, the portion of the boundary 115 extending from the fourth corner 144 to the third corner 143 may have a different configuration than what is shown. In the direction from the fourth corner 144 to the third corner 143, this segment of the boundary 115 may include outer portions that are located progressively farther outward or inward. Similarly, this segment of the boundary 115 may include inner portions that are aligned or that are located progressively farther outward in a direction from the fourth corner 144 to the third corner 143. Therefore, a multitude of configurations may be implemented for the various segments of the boundary 115.

The formliner 100 may further include cutouts along the boundary 115. As shown in FIG. 1E, the formliner 100 may have a first cutout 151 and a second cutout 153. The cutouts 151, 153 maybe located at the corners of the formliner 100. As shown, the first cutout 151 may be located at the first corner 141, and the second cutout 153 may be located at the third corner 143. This is merely one example, and there need not be two cutouts. There may be no cutouts. There may only be one cutout. For example, there may only be a single cutout 153 at the third corner 143, but no cutout at the first corner 141. The overlapped section 120 may be formed to extend further, transversely to the overlapping section 130 to replace the cutout 151 illustrated in FIG. 1E. A transition zone from the overlapped section 120 to the overlapping section 130 may be positioned where the end of the overlapping section 130 is illustrated at cutout 151 in FIG. 1E.

There may be three or four cutouts. For example, there may be one or two additional cutouts besides what are shown in FIG. 1E, such as a cutout at the second corner 142 and/or a fourth cutout at the fourth corner 144. The various cutouts may be formed by interfaces of various portions of the boundary 115. For example, as shown, the first cutout 151 may be formed by an interface of the overlapping section 130 and the overlapped section 120 at the first corner 141. Similarly, as shown, the second cutout 153 may be formed by an interface of the overlapped section 120 and the overlapping section 130 at the third corner 143. Therefore, the cutouts may be formed on one side by the end of one portion of the boundary 115 and on the other side by the end of another portion of the boundary 115. For example, as shown, the first cutout 151 at the first corner 141 is formed on one side by an end of the overlapping section 130 and on the other side by an end of the overlapped section 120. The second cutout 153 may be similarly formed at the third corner 143. These are merely some examples of possible configurations for the cutouts and others that are suitable may be implemented.

Figure 1F:
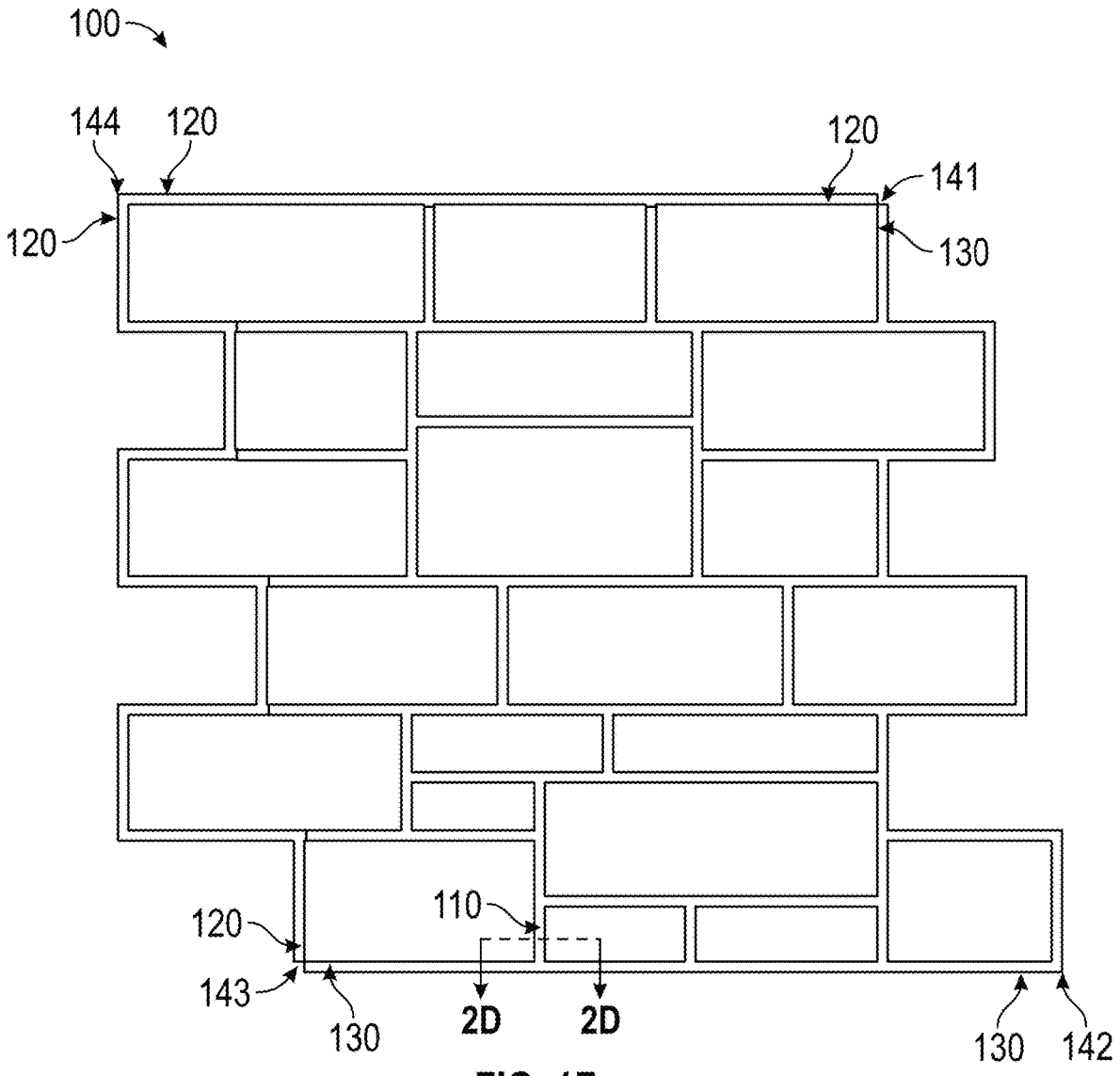
FIG. 1F is a bottom view of the formliner of FIGS. 1A-1B.

FIG. 1F is a bottom view of the formliner 100. As shown, the channels 110 may connect with each other and form a system or network of the channels 110 along the bottom of the formliner 100. The channels 110 may extend toward and interface with the overlapped sections 120 and/or the overlapping sections 130. As mentioned, the channels 110 may be features of the ribs 102. Thus, the channels 110 may have a layout that resembles the general layout of the ribs 102. It is understood that the configuration of the channels 110 as shown is merely one example and that other suitable configurations may be implemented.

Figure 2A:
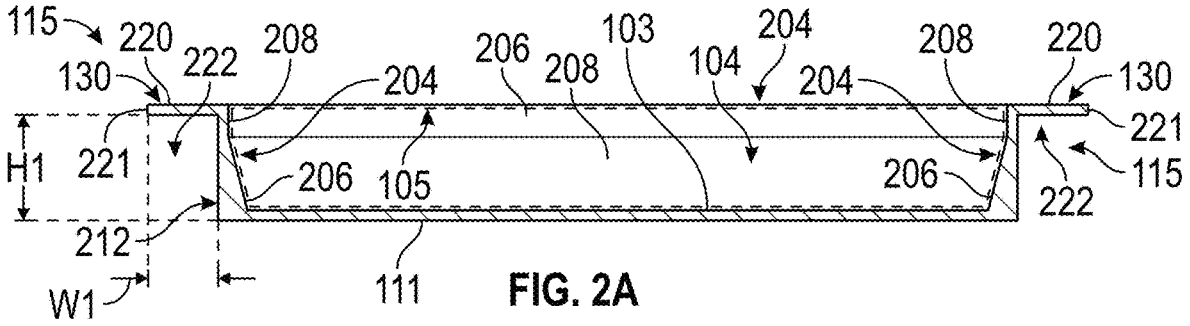
FIG. 2A is a cross-section view of a portion of the formliner of FIGS. 1A-1B as taken along the lines 2A-2A as indicated in FIG. 1E.

FIG. 2A is a cross-section view of a portion of the formliner 100 as taken along the lines 2A-2A as indicated in FIG. 1E. As shown in FIG. 2A, the cell 104 may be bounded on two sides by the boundary 115. On one side of the cell 104, the boundary 115 may include an overlapping section 130. The opposite side of the cell 104 may also include an overlapping section 130. It is understood that one or both of the portions of the boundary 115 shown in FIG. 2A may be overlapped sections 120, as discussed in further detail herein for example with respect to FIG. 2B. It is further understood that the overlapping sections 130 and the overlapped sections 120 are sections or segments of the ribs 102. Therefore, the ribs 102 may have either an overlapping section 130 or they may be shaped like the overlapped section 120. Thus, the boundary 115 may include the ribs 102 as either the overlapped sections 120 or the overlapping sections 130.

Each of the sections 120, 130 may be formed from one or more walls or segments. As shown in FIG. 2A, the overlapping section 130 may include a first wall 204. The first wall 204 may be connected to and extend away from the base 103 (e.g., generally perpendicular to the base 103). The first wall 204 may be directly connected to the base 103. As shown, the first wall 204 and the base 103 may be integral such that they are formed from the same monolithic piece of material. The first wall 204 may be attached to the base 103 with various suitable mechanical attachments, such as nails, rivets, adhesive, tape, string, or other suitable means.

The first wall 204 may include various segments or portions thereof. As shown, the first wall 204 may include an angled portion 206 and a straight portion 208. The angled portion 206 may be connected to the base 103 on one end and on the opposite end connected to the straight portion 208. Therefore, the side of the first wall 204 that faces the cell 104 may have straight and/or angled portions. The angled portion 206 can be provided to facilitate removal of the formliner 100 from the curable material once the curable material has set. Other contours that are suitable may also be implemented. The side of the first wall 204 that faces away from the cell 104 is shown as flat. However, this side of the first wall 204 may also have a variety of contours, including straight and/or angled portions, round portions, other portions, or combinations thereof.

The side of the first wall 204 that faces the cell 104 may extend around the cell 104. As shown, two portions of the first wall 204 are shown in cross-section while a third portion of the first wall 204 is visible in between the two cross-sections. Therefore, portions of the angled portion 206 and the straight portion 208 are likewise seen in between the two overlapping sections 130 as oriented in FIG. 2A.

The first wall 204 may include a lower region or lower portion 212 (e.g., an inner portion 212 relative to the straight portion 208). The lower portion 212 of the first wall 204 may be on a side of the first wall 204 that is opposite the cell 104. The lower portion 212 may refer to an area or region of intersection of the first wall 204 and the base 103. The intersection of the base 103 and the lower portion 212 (and in particular, the angled portion 206 of the first wall 204) can form the perimeter or periphery of the cell 104 as discussed herein, such as, for example periphery 210 in reference to FIGS. 1B and 2B. The lower portion 212 may be formed by the intersection of the bottom surface 111 and the first wall 204. This intersection may be a sharp point as shown, or it may be rounded, other shapes, or combinations thereof. Further, the lower portion 212 may include more than just the point or intersection of the first wall 204 and the bottom surface 111. For instance, the lower portion 212 may extend along the first wall 204 for a distance toward the second wall 220. Therefore, the lower portion 212 need be the lowest area of the outside surface of the first wall 204, but may include other portions of the first wall 204 there above. The lower portion 212 may extend from the first end of the first wall 204 to a location halfway along the first wall 204. Thus, the lower portion 212 may have a length approximately equal to half the length of H1.

The overlapping section 130 may further include a second wall 220. The second wall 220 may be connected to the first wall 204. The first wall 204 may be connected to the base 103 on one end of the first wall 204 and on the opposite end may be connected to the second wall 220. As shown, the second wall 220 may connect with an end of the straight portion 208 of the first wall 204. The second wall 220 may be integral with the first wall 204 such that they are made from the same monolithic piece of material. The second wall 220 may be mechanically attached to the first wall 204 in a variety of manners, including those described above with respect to the first wall 204 and the base 103, as well as others. As shown, the second wall 220 may extend generally outward or away from the cell 104 (e.g., generally parallel with the base 103). The direction of extension of the second wall 220 may be generally perpendicular to the general direction of extension of the first wall 204. For example, the second wall 220 may extend in a direction that is substantially perpendicular to the direction of extension of the straight portion 208 of the first wall 204. The second wall 220 may also extend in any direction that is substantially parallel with the base 103. However, these are merely some examples and a variety of configurations of the second wall 220 may be implemented. The second wall 220 may not be generally perpendicular to the first wall 204 or generally parallel with the base 103. For instance, the second wall 220 may extend generally away from the cell 104 and downward as oriented in FIG. 2A.

The second wall 220 may include a free end 221 (e.g., a rib edge, first rib edge, rib end, first rib end). The free end 221 of the second wall 220 may be on an end of the second wall 220 opposite that of the end that is connected with the first wall 204. The free end 221 may therefore be an edge of the overlapping section 130 and thus an edge of the ribs 102. The free end 221 may be generally flat as shown. The free end 221 may have other shapes, such as pointed, rounded, segmented, other shapes or contours, or combinations thereof.

The overlapping section 130 may have a variety of sizes and dimensions. As shown, the overlapping section may have a height equivalent to the dimension H1 as shown in FIG. 2A based on inner surfaces of the second wall 220 (e.g., surfaces facing the first space 222). As shown, the first wall 204 may extend for a length equivalent to L1. As further shown, the overlapping section 130 may have a width equivalent to the dimension W1 as indicated in FIG. 2A. As shown, the second wall 220 of the overlapping section 130 may have a length equivalent to the dimension W1.

The overlapping section 130 may define or form a first space 222. As shown and as oriented in FIG. 2A, the first space 222 may be defined by the area underneath the second wall 220 and on the side of the first wall 204 that is opposite from the cell 104. As shown, the first space 222 may have a width equivalent to the dimension W1 as indicated. As further shown, the first space 222 may have a height equivalent to the dimension H1. As illustrated, the first wall 204 and the second wall 220 may form a generally L-shaped cross-sectional (e.g., L section) profile at least partially bounding the first space 222. The first space 222 defined by the overlapping section 130 of the formliner 100 may be configured to receive a portion of the overlapped section 120 of another formliner, as discussed in further detail herein, for example with respect to FIGS. 4A-4B.

As mentioned, the cells 104 may define a cell volume 105. As shown in FIG. 2A, the cell volume 105 may extend from the base 103 to a top edge of the overlapping section 130. The cell volume 105 may extend from the base 103 to a corner formed by the interface of the first wall 204 and the second wall 220. Further, the cell volume 105 may extend from one first wall 204 to an opposite first wall 204, as shown. The cell volume 105 may therefore have an outer contour that matches the inner surfaces defining the cell 104. For example, the cell volume 105 may be bounded by the first wall 204, which may include the angled portion 206 and the straight portion 208, as well as by the base 103. Further, as mentioned, the cell volume 105 is shown in dashed lines because it is a geometric reference as opposed to a physical feature of the formliner 100. The dashed lines indicating the boundary of the cell volume 105 are slightly offset from the various bounding features of the cell 104 for purposes of clarity, however it is understood that the cell volume may extend to and contact these various features, as described herein.

Figure 2B:
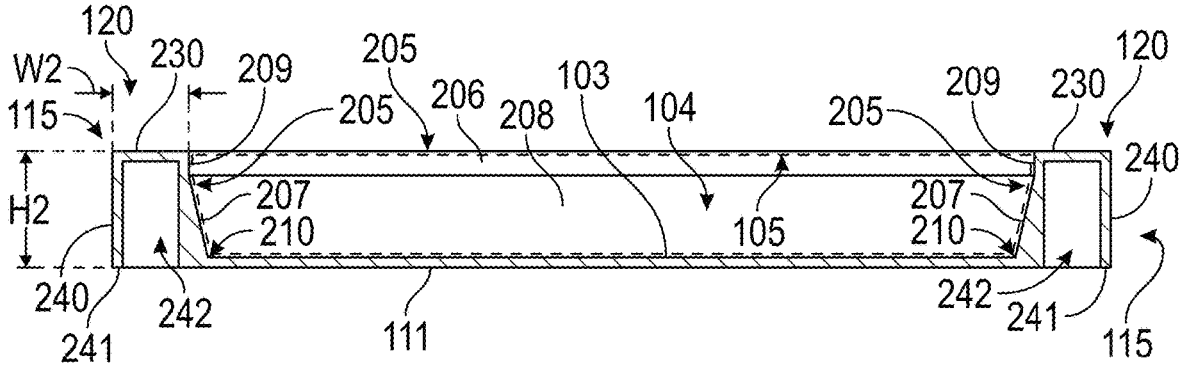
FIG. 2B is a cross-section view of a portion of the formliner of FIGS. 1A-1B as taken along the lines 2B-2B as indicated in FIG. 1E.

FIG. 2B is a cross-section view of a portion of the formliner 100 as taken along the lines 2B-2B as indicated in FIG. 1E. As shown in FIG. 2B, the cell 104 may be bounded on opposite sides by the boundary 115, where the boundary 115 includes the overlapped sections 120. The overlapped sections 120 may include a first wall 205 connected to and extending away from the base 103 as shown. The first wall 205 of the overlapped section 120 may have similar features and functionalities as the first wall 204 of the overlapping section 130 described herein. For instance, as shown, the first wall 205 of the overlapped section 120 may include an angled portion 207 and a straight portion 209, which may be vertical as oriented. The angled portion 207 may be connected to the base 103 on one end and connected to the straight portion 209 on the opposite end.

The first wall 205 may connect with a second wall 230. The second wall 230 may have similar features and functionalities as the second wall 220 of the overlapping section 130. However, one difference is that the second wall 230 may be further connected to a third wall 240. The third wall 240 may be connected to the second wall 230 and extend in a direction away from the second wall 230 as shown. The third wall 240 may be integral with the second wall 230 such that they are formed from the same monolithic piece of material. The third wall 240 may be connected or coupled with the second wall 230 in the same or similar manner described with respect to the connection between the second wall 220 and the first wall 204 of FIG. 2A.

As further shown in FIG. 2B, the third wall 240 may have a free end 241 (e.g., a rib edge, second rib edge, rib end, first rib end). The free end 241 of the third wall 240 may be on an end of the third wall 240 that is opposite that of the end that is connected to the second wall 230. As shown, the third wall 240 may extend in a generally downward direction as oriented in the figure such that the free end 241 is in a same or similar plane as the base 103 or bottom surface 111 of the cell 104. Therefore, as illustrated, the free end 241 may align with a bottom surface 111 of the cell 104. The bottom surface 111 may therefore be aligned with the free end 241 of the third wall 240. The third wall 240 may extend in a direction generally parallel to the first wall 205, generally perpendicular to the second wall 230, and/or generally perpendicular to the base 103 or bottom surface 111.

Each of the walls of the ribs 102 can have an extent, length, dimension along the cross-sectional profiles illustrated in, for example, FIGS. 2A and 2B. Where the extents of the wall of the ribs 102 connect can form edges or corners of the ribs 102 or walls. For example, the connection of the first wall 204 to the second wall 220 can form an edge or corner as illustrated in, for example, FIG. 2A. The connection of the first wall 205 to the second wall 230 can form an edge or corner as illustrated in, for example, FIG. 2B. The second wall 230 connecting to the third wall 240 can form an edge or corner as illustrated in, for example, FIG. 2B. The dimension or length between the edges or corners can be an extent of the walls as discussed herein. The extents can be perpendicular to a corresponding extent where the walls connect.

The overlapped section 120 may define or otherwise form a second space 242. As shown, the second space 242 may be bounded on three sides by the overlapped section 120. The second space 242 may be empty space as shown. The second space 242 may be filled, either partially or entirely, with material. The overlapped section 120 may include a solid second space 242 with the first wall 205, the second wall 230, and the third wall 240 being outer surfaces of the second space 242. As illustrated, the first wall 205 and the second wall 230 may form a generally C-shaped cross-sectional profile (e.g., C section) at least partially bounding the second space 242. The generally C-shaped cross-sectional profile can be rounded (e.g., horse-shoe shaped) or with a square/rectangular configuration as illustrated in FIG. 2B.

Similar to the cell 104 as described in FIG. 2A, the cell 104 shown in FIG. 2B may also be bounded by the side of the first wall 205 that faces the cell 104. Thus, the first wall 205 may extend around the boundary of the cell 104, such that a portion of the first wall 205 is visible in between the two cross-sections of the overlapped sections 120 as oriented in the figure.

As further shown in FIG. 2B, the cell 104 may include a perimeter, boundary or periphery 210 (e.g., an inner perimeter, boundary, or periphery). As shown, the periphery 210 may be formed by the interface of the base 103 with the first wall 205 (e.g., angled portion 207). The periphery 210 may be a vertex formed by the intersection of the base 103 and the first wall 205. The periphery 210 may therefore be inside the cell 104. The periphery 210 may not be a sharp corner but may be rounded instead. The periphery 210 may be a sharp corner in some locations along the periphery 210 of the cell 104 and it may be rounded or other shapes at other portions of the periphery 210 of the cell 104. Further, the periphery 210 may generally extend beyond the intersection of the first wall 205 and the base 103 within, for example, the cell volume 105. The periphery 210 may have contours and shapes that follow along a textured pattern that may be formed in the base 103 as discussed herein. For example, the periphery 210 may be not a straight line along the intersection of the base 103 and the first wall 205.

Further shown in FIG. 2B is the cell volume 105. The cell volume 105 may have any of the features and functionalities as described herein. Further, the cell volume 105 may be defined by the various features of the cell 104 as described with respect to FIG. 2B. For example, the cell volume 105 may be defined by the first wall 205, the base 103, the periphery 210, the angled portion 207, the straight portion 209, and/or other features.

The overlapped section 120 may have a variety of sizes and dimensions. Further, because the overlapped section 120 of one formliner may be assembled with the overlapping section 130 of another formliner, the various dimensions of these sections may be sized to facilitate such overlapping. That is, the overlapping section 130 of a second formliner 100 may overlay onto the overlapped section 120 of a first formliner 100. Therefore, the second wall 220 of the overlapping section 130 of a second formliner 100 may rest on the second wall 230 of the overlapped section 120 of a first formliner 100. Similarly, the outer surface of the first wall 204 of the overlapping section 130 of a second formliner 100 may abut or otherwise contact the third wall 240 of the overlapped section 120 of a first formliner 100. As indicated in FIG. 2B, the second wall 230 may have a length equivalent to the dimension W2, and the third wall 240 may have a length equivalent to the dimension H2 based on outer surfaces of the second and third walls 230, 240 (e.g., surfaces opposite, not facing, the second space 242).

Figure 4A:
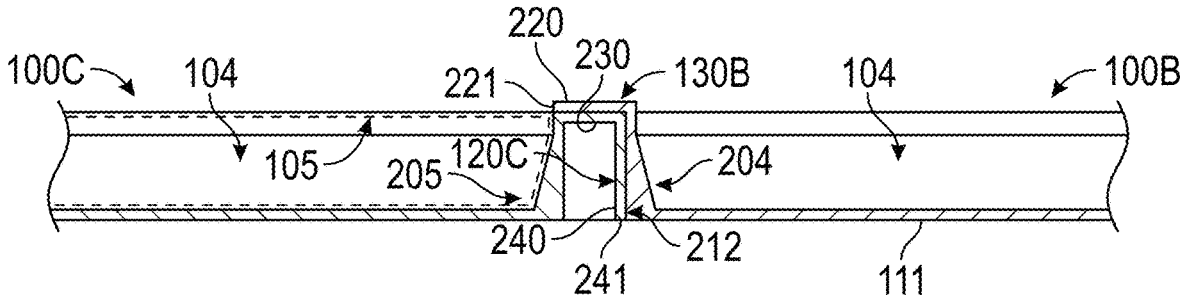
FIG. 4A is a cross-section view of the assembly of FIG. 3A as taken along the line 4A-4A as indicated in FIG. 3A.
Figure 4B:
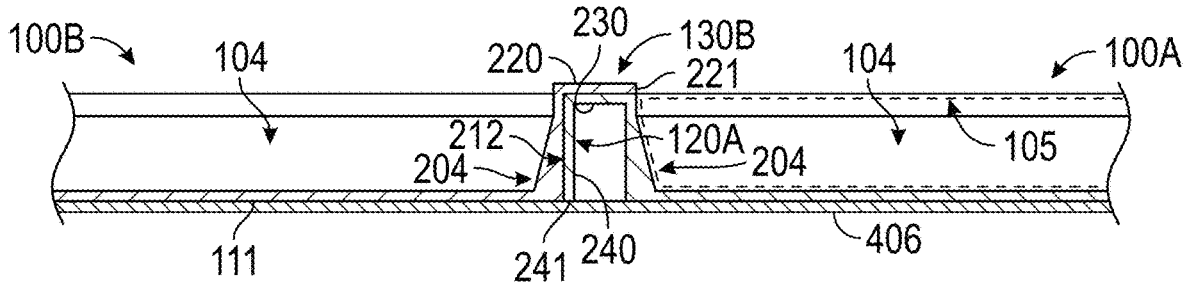
FIG. 4B is a cross-section view of the assembly of FIG. 3A as taken along the line 4B-4B as indicated in FIG. 3A.

As discussed in further detail herein, for example with respect to FIGS. 4A-4B, the overlapping section 130 may overlay onto the overlapped section 120. Therefore, the dimension W1 shown in FIG. 2A may be substantially equivalent to the dimension W2 in FIG. 2B. Thus, the length of the second wall 220 of the overlapping section 130 that extends beyond the first wall 204 may be substantially equivalent to the length of the second wall 230 of the overlapped section 120. Similarly, the length of the first space 222 as indicated by the dimension H1 may be substantially equivalent to the length of the third wall 240 of the overlapped section 120 as indicated by the dimension H2. W1 can be equivalent to W2. However, there may be some reasonable deviation between W1 and W2. W1 may be slightly less than W2, for example to accommodate manufacturing tolerances. Similarly, H1 may be equivalent to H2. However, some reasonable deviation between H1 and H2 may be implemented. H1 may be slightly larger than H2, for example to accommodate for manufacturing tolerances. These are just some of the possible relationships between the dimensions and others are possible.

Figure 2C:
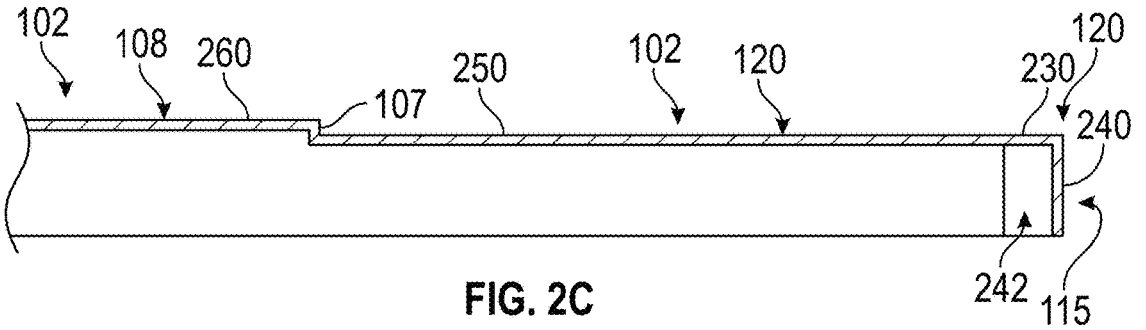
FIG. 2C is a cross-section view of a portion of the formliner of FIGS. 1A-1B as taken along the line 2C-2C as indicated in FIG. 1E.

FIG. 2C is a cross-section view of a portion of the formliner 100 as taken along the line 2C-2C as indicated in FIG. 1E. As shown in FIG. 2C, the rib 102 includes the transition zone 107. The transition zone 107 is in between the internal section 108 and the overlapped section 120 of the rib 102. The transition zone 107 may be a step as shown in FIG. 2C. However, other configurations are possible. The transition zone 107 may be an angled step, a rounded feature, other shapes, or combinations thereof. The transition zone 107 may provide a transition between portions of the rib 102 with different cross-sections. The transition zone 107 may provide a transition between portions of the rib 102 that are at different relative heights or lengths with respect to each other. As shown, the overlapped section 120 may include a top surface 250 that is lower than a top surface 260 of the internal section 108. The transition zone 107 may therefore connect the top surface 250 of the overlapped section 120 to the top surface 260 of the internal section 108. The underside of the transition zone 107 is also shown as a vertical step as oriented. However, the underside of the transition zone 107 may have a variety of shapes, configurations and contours, which may be similar to the top side of the transition zone 107 as described above.

Figure 2D:
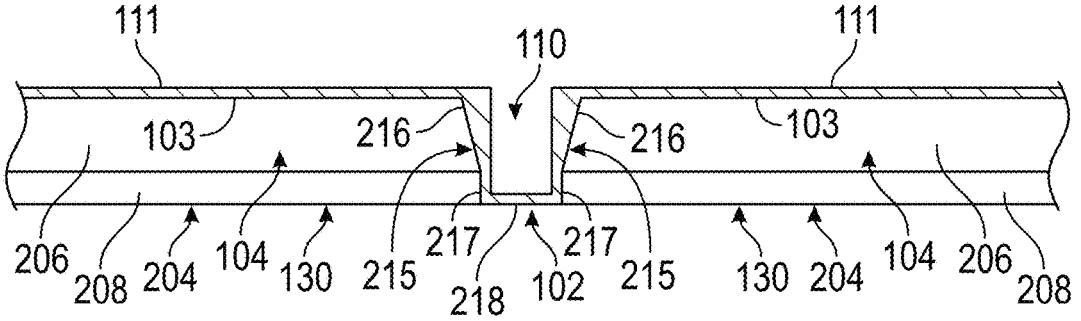
FIG. 2D is a cross-section view of a portion of the formliner of FIGS. 1A-1B as taken along the line 2D-2D as indicated in FIG. 1F.

FIG. 2D is a cross-section view of a portion of the formliner 100 as taken along the line 2D-2D as indicated in FIG. 1F. As shown, two cells 104 may be on either side of the channel 110. The channel 110 may be formed or defined by the walls 215 that are in between the channel 110 and the two adjacent cells 104. The walls 215 may have similar features and/or functionalities as the first wall 204 and/or the first wall 205 described, for example, with respect to FIGS. 2A and 2B. As shown in FIG. 2D, the wall 215 may include an angled portion 216 and a straight portion 217. The angled portion 216 and straight portion 217 may have similar features and functionalities as the angled portion 206 and straight portion 208, respectively, of the first wall 204 of the overlapping section 130. The walls 215 need not have various angled or straight portions. The walls 215 may be a single segment. For example, the walls 215 may be one angled portion, one straight portion, or other suitable configurations.

The wall 215 may be connected to or otherwise coupled with the base 103. As shown, the angled portion 216 of the wall 215 may be connected to or otherwise coupled with the base 103. The wall 215 and the corresponding base 103 to which the wall 215 is coupled may be formed from the same continuous monolithic piece of material. The wall 215 may be a separate piece that is mechanically connected with the base 103.

The walls 215 of the two adjacent cells 104 may be connected by a bridge 218 (e.g., similar to second walls 220, 230). The bridge 218 may be connected to or otherwise coupled with the walls 215. As shown, the bridge 218 may be connected to or otherwise coupled with the straight portion 217 of the walls 215. Therefore, the channel 110 may be defined by the walls 215 and the bridge 218. The channel 110 is shown as a space defined by the various structures. The channel 110 may be filled in partially or entirely with material, as mentioned. Therefore, the walls 215 and/or the bridge 218 may be surfaces of the channel 110. For example, the channel 110 may be a solid piece of material wherein the side surfaces of the channel 110 may form the wall 215 and the end of the channel 110 may form the bridge 218.

As further shown in FIG. 2D, the cells 104 may include overlapping sections 130 on either side of the walls 215. Therefore, the overlapping sections 130 may be extending away from the walls 215 on either side of the rib 102. As shown, various portions of the overlapping sections 130 may connect with the walls 215. For example, the overlapping section 130 may include the first wall 204, as mentioned above. Thus, the first wall 204 may connect to or otherwise couple with the wall 215. The first wall 204 may include the angled portion 206 and/or the straight portion 208, as shown. Therefore, the angled portion 206 of the first wall 204 may connect to or otherwise couple with the angled portion 216 of the wall 215, and/or the straight portion 208 of the first wall 204 may connect to or otherwise couple with the straight portion 217 of the wall 215. The angled portion 206 of the first wall 204 and the angled portion 216 of the wall 215 may have the same size, shape, and configuration. Similarly, the straight portion 208 of the first wall 204 and the straight portion 217 of the wall 215 may have the same size, shape and or configuration. However, these features need not be the same and the configurations shown and described are merely one suitable configuration.

Figure 3A:
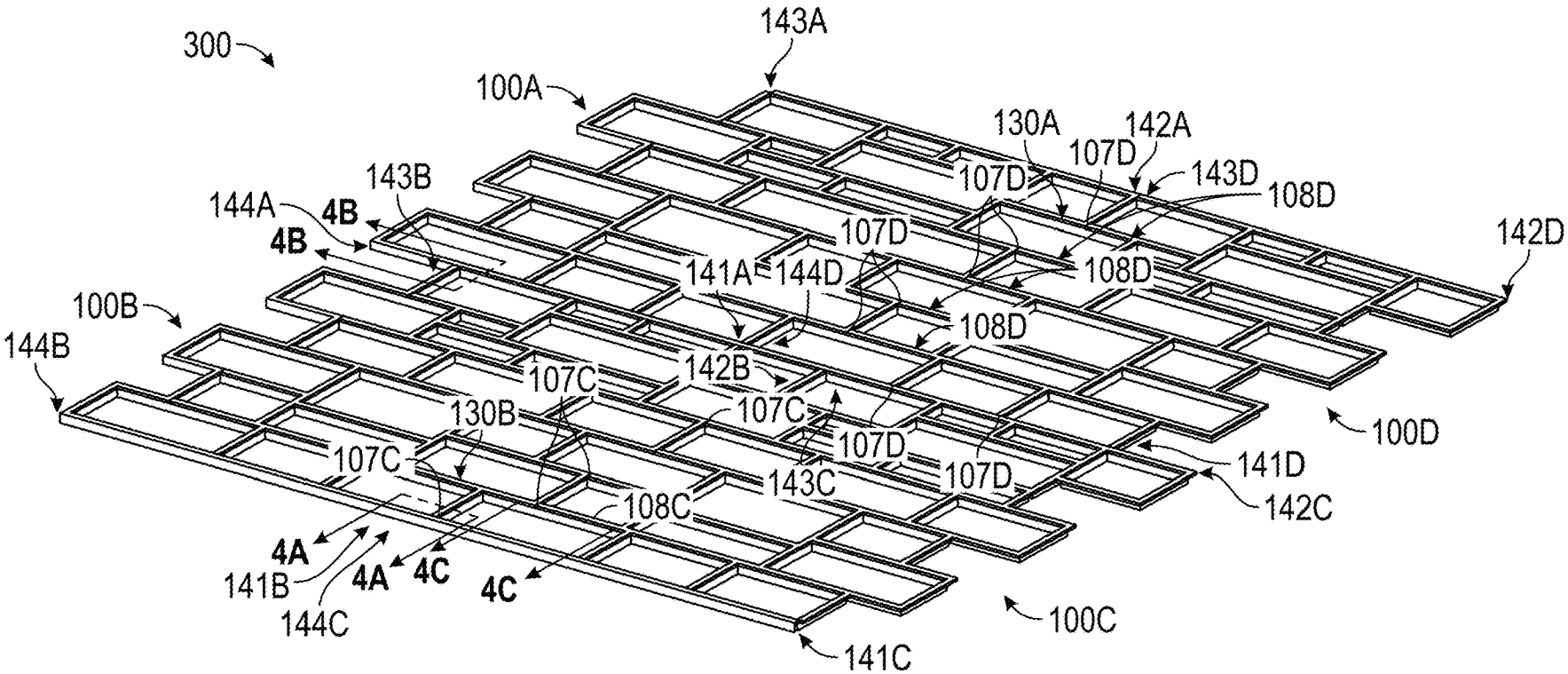
FIG. 3A is a top perspective view of an assembly of formliners.
Figure 3B:
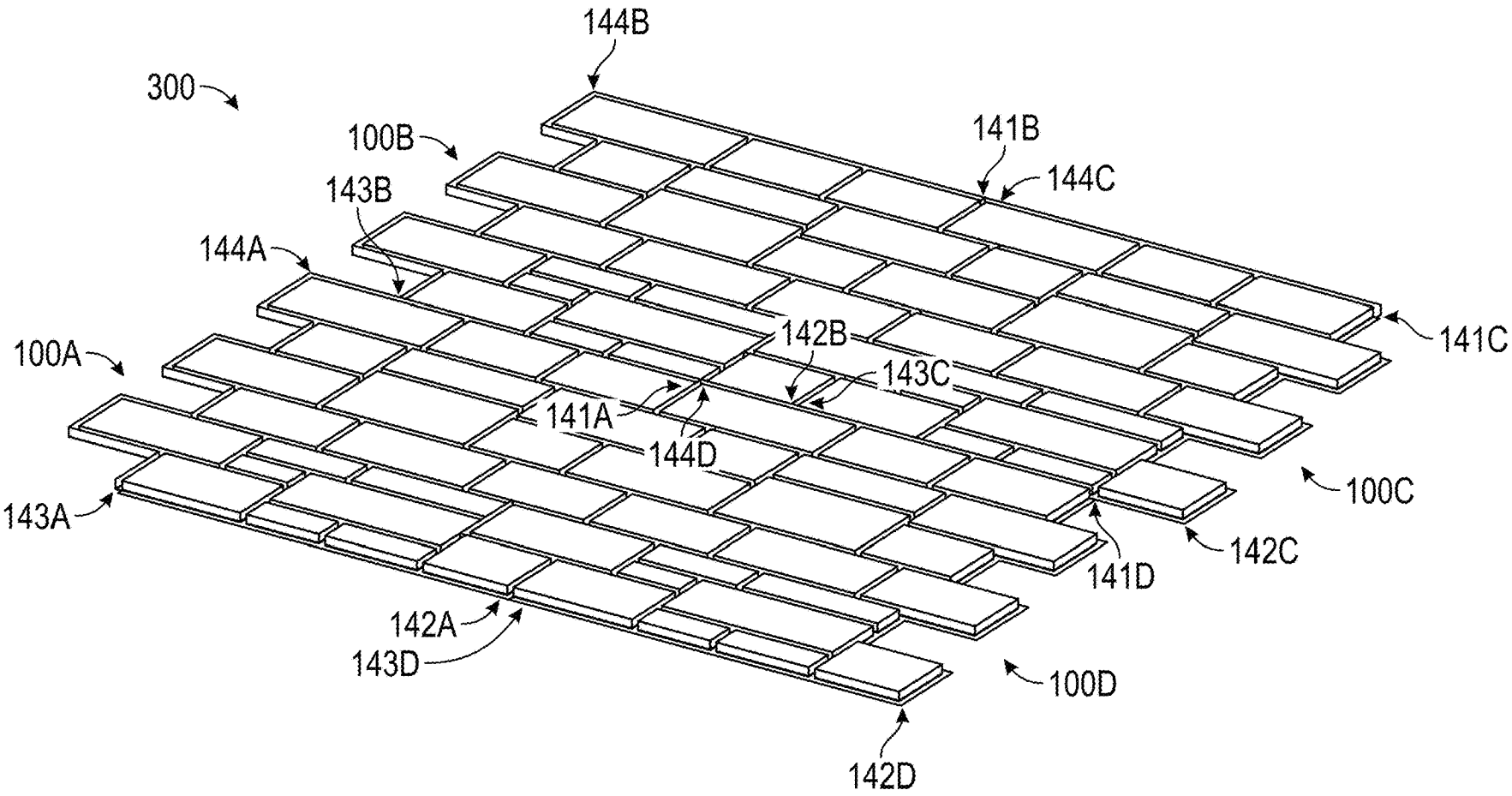
FIG. 3B is a bottom perspective view of the assembly of FIG. 3A.

FIG. 3A is a top perspective view of an assembly 300 of various formliners 100, and FIG. 3B is a bottom perspective view of the assembly 300. As shown, the assembly 300 may include a formliner 100A, a formliner 100B, a formliner 100C and a formliner 100D. These formliners may be the same or similar as the formliner 100 described herein. Therefore, although different designations maybe given to the various formliners shown in the assembly 300, it is understood that the four formliners 100A, 100B, 100C, 100D may all be the same formliner. In this manner, multiple formliners with the same configurations may be assembled together. Further, the assembly 300 is merely one example, and the formliners may be assembled in other configurations. Two, three, five, six, ten, fifteen, fifty, or more formliners may be assembled together.

As shown, the four formliners 100A, 100B, 100C, 100D may be assembled in a 2×2 assembly. That is, the assembly 300 may include two formliners 100A, 100B aligned next to two other formliners 100C, 100D that may be similarly aligned. The four assembled formliners 100A, 100B, 100C, 100D as shown may have similar features and functionalities as the formliner 100 described above. For example, the formliner 100A may have a first corner 141A, a second corner 142A, a third corner 143A, and a fourth corner 144A. Similarly, the formliner 100B may have a first corner 141B, a second corner 142B, a third corner 143B, and a fourth corner 144B. Similarly, the formliner 100C may have a first corner 141C, a second corner 142C, a third corner 143C, and a fourth corner 144C. Similarly, the formliner 100D may have a first corner 141D, a second corner 142D, a third corner 143D, and a fourth corner 144D. The various corners may be similar to the corners of the formliner 100D described herein. Thus for example referring to formliner 100A, the first corner 141A may be similar to the first corner 141 of the formliner 100, the second corner 142A may be similar to the second corner 142 of the formliner 100, the third corner 143A may be similar to the third corner 143 of the formliner 100, and the fourth corner 144A may be similar to the fourth corner 144 of the formliner 100. The respective corners of the other three formliners 100B, 100C, 100D in the assembly 300 may also have the same features and/or functionalities as the respective corners of the formliner 100.

As shown, the formliners 100A, 100B, 100C, 100D may be assembled by bringing together various complementary portions of the boundaries of the formliners. Thus, the first corner 141A of the formliner 100A may contact, interface with, abut, join, assemble with, meet, or otherwise be adjacent to the fourth corner 144D of the formliner 100D. The second corner 142B of the formliner 100B may be adjacent to the third corner 143C of the formliner 100C. These junctures of the formliners in the assembly 300 may be generally on the interior of the assembly 300. However, there may be junctures along or near the outer perimeter of the assembly 300. As shown, the first corner 141B of the formliner 100B may be adjacent to the fourth corner 144C of the formliner 100C. The second corner 142A of the formliner 100A may be adjacent to the third corner 143D of the formliner 100D. The fourth corner 144A of the formliner 100A may be near the third corner 143B of the formliner 100B. The first corner 141D of the formliner 100D may be near the second corner 142C of the formliner 100C.

The order of assembly of the formliner 100A, 100B, 100C, 100D may be as follows. The first formliner positioned for assembly may be formliner 100D. Next, the overlapping sections 130 of either formliner 100A or formliner 100C can be overlaid onto the overlapped sections 120 of formliner 100D. For example, formliner 100A can be laid down as the second formliner assembled, and formliner 100C can be laid down as the third formliner assembled. As another example, formliner 100C can be laid down as the second formliner assembled, and formliner 100A can be laid down as the third formliner assembled. Formliner 100A and formliner 100D may be laid down simultaneously to couple with formliner 100D (e.g., the first formliner). Formliner 100B can be laid down as the fourth formliner assembled to couple with formliners 100A, 100C, and 100D. When continuing to assemble five or more formliners, assembled formliner 100A can be considered the first formliner (e.g., as formliner 100D was when connecting the first four formliners) to connect with additional formliner in the order discussed above.

The formliners may also contact each other (e.g., connect, assemble, overlay) along the boundaries 115 of the formliners. As shown, the formliner 100B may contact the formliner 100C along an interface from the juncture of the second corner 142B and the third corner 143C, and extending to the juncture of the first corner 141B and the fourth corner 144C. Similarly, the formliner 100A may contact the formliner 100D along an interface extending from the juncture of the second corner 142A and the third corner 143D to the juncture of the first corner 141A and the fourth corner 144D. Along these interfaces, the various transition zones of the formliners may contact the overlapping sections of adjacent formliners. As shown, the overlapping section 130A of the formliner 100A may contact in various locations the transition zones 107D of the formliner 100D. Similarly, the overlapping section 130B of the formliner 100B may contact various transition zones 107C of the formliner 100C. A cross-section view of one such interface as taken along the line 4C-4C as indicated in FIG. 3A is shown in FIG. 4C.

The various formliners may further have interfaces along other sides of the boundaries of the formliners. As shown in FIG. 4C, the formliner 100B may contact the formliner 100C along an interface that extends from the first corner 141B to the third corner 143C. Similarly, the formliner 100A may contact the formliner 100B along an interface that extends from the first corner 141A to the third corner 143B. These interfaces may be generally straight as shown, however other configurations may be implemented. Further, along these interfaces the formliners may contact the transition zones of adjacent formliners. As shown, along this last described interface, the transition zones 107C from the formliner 100C may contact the formliner 100B. A similar interface may exist between the formliner 100A and the formliner 100B, or other interconnecting formliners.

Figure 4C:
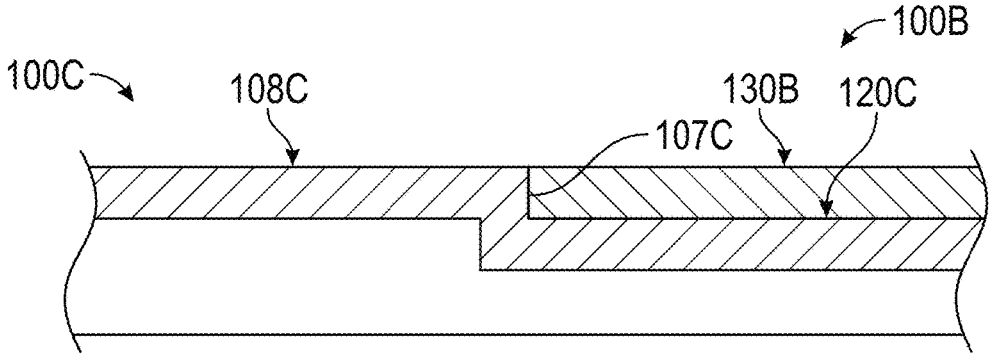
FIG. 4C is a cross-section view of the assembly of FIG. 3A as taken along the line 4C-4C as indicated in FIG. 3A.

FIGS. 4A-4C show various cross-section views of assembly 300 as taken along respective lines as indicated in FIG. 3A. Namely, FIG. 4A is a cross-section view of a portion of the assembly 300 as taken along the line 4A-4A, FIG. 4B is a cross-section view of a portion of the assembly 300 as taken along the line 4B-4B, and FIG. 4C is a cross-section view of a portion of the assembly 300 as taken along line 4C-4C.

Referring to FIG. 4A, a portion of the assembly 300 is shown where the formliner 100B interfaces with the formliner 100C. As shown, the overlapping section 130B overlaps the overlapped section 120C. This overlapping section 130B may be similar to the overlapping section 130 described herein. This overlapped section 120C may be similar to the overlapped section 120 described herein. Therefore, as shown, the overlapping section 130B may include the first wall 204 coupled with the second wall 220. The overlapped section 120C may include the first wall 205 coupled with the second wall 230 and the second wall 230 coupled with the third wall 240. Further, the second wall 220 may have the free end 221, and the third wall 240 may have the free end 241.

As shown, the overlapping section 130B partially abuts and partially rests upon the overlapped section 120C. The two formliners 100B and 100C may be brought into contact with each other in a variety of ways. For example, the formliners 100B and 100C may be manually brought into contact with each other by a user, a machine may place them in the shown configuration, other processes may be used, and/or come combinations thereof. As shown, the third wall 240 may contact the first wall 204. The third wall 240 may abut the first wall 204. There may be no void or space in between the third wall 240 and the first wall 204 such that the respective surfaces completely/directly contact each other. The third wall 240 may partially contact the first wall 204.

The first wall 204 may include a lower portion 212, as described in further detail herein, for example with respect to FIG. 2A. As shown in FIG. 4A, the assembled formliners 100B, 100C may include the third wall 240 contacting or otherwise being located near or adjacent the first wall 204. The third wall 240 may contact or otherwise be near the lower portion 212. The free end 241 may contact or otherwise be near the first wall 204. The free end 241 may contact or otherwise be near or adjacent the lower portion 212. The free end 241 may be coplanar or coextensive (e.g., end) with the bottom surface 111 of the cell 104 of the formliner 100B. Therefore, a variety of configurations between the third wall 240 and the first wall 204 may be implemented.

The assembled formliners 100B, 100C may include the second wall 230 contacting or otherwise being adjacent to the second wall 220. As shown, the second wall 230 may substantially contact the second wall 220. However, similar to the interface between the third wall 240 and the first wall 204, the second walls 220, 230 need not entirely contact one another. The second wall 220 may partially contact the second wall 230. The second wall 220 may be near or otherwise adjacent the second wall 230. As shown, the free end 221 of the second wall 220 may be near or otherwise adjacent the first wall 205 of the overlapped section 120. As shown, the second wall 220 may extend such that it is substantially coextensive with the first wall 205 (e.g., end at or on end of the first wall 205 or where the first wall 205 and the second wall 230 are connected, such as, for example where the first wall 205 and the second wall 230 form a corner). The free end 221 may therefore be coextensive with an edge or surface of the first wall 205. The free end 221 of the second wall 220 may be coextensive with a straight portion of the first wall 205. As shown in FIG. 4A (and FIG. 4B), the overlapping section 130 (e.g., first and second walls 204, 220) can be overlaid to extend about two-thirds of an overall length of the overlapped section 120 (e.g., the second and third walls 230, 240). In particular, the combined length of the first and second wall 204, 220 of the overlapping section 130 can extend about the combined length of the second and third walls 230, 240 of the overlapped section 120.

The formliner 100C may include the cell volume 105 defined by the cell 104 and the base 103. As shown, the cell volume 105 may be a space defined or otherwise formed by the perimeter of the cell 104. The cell volume 105 may be a geometric reference volume of the cell 104 in which the adjacent formliners do not enter or otherwise extend into. As shown, the formliner 100B (e.g., overlapping section 130B and in particular, the second wall 220) may extend adjacent to the cell volume 105 without entering the cell volume 105. In particular, the overlapping section 130B of the formliner 100B may extend near to but not enter the cell volume 105. The second wall 220 of the overlapping section 130B may extend close to or adjacent the cell volume 105 without extending into the cell volume 105 (e.g., to not contact or extend downwardly into the cell 104 or cell volume 105 toward the perimeter 210 discussed herein).

As discussed herein, the perimeter 210 may be not a straight line, but have an outline or contour that generally follows a textured pattern of a base 103 as discussed herein (e.g., where the first wall 204 and the base 103 connect). Accordingly, the perimeter 210 can have a changing or substantially random contour, line, or edge following the outline of the textured pattern formed in the base 103. Accordingly, extending the free end 221 downward into the cell 104 or cell volume 105 along the first wall 205 to extend along the perimeter 210 may create seams. For example, if the free end 221 ends somewhere along the vertical extent or longitudinal length of the first wall 204, a substantially visible seam may be formed in the curable material along the first wall 204 where the free end 221 would terminate. Conversely, if the free end 221 were to extend up to the perimeter 210, it would be difficult and cumbersome to form/trim the free end 221 such that the end of the free end 221 followed the contour/outline of the textured pattern of the base 103 when the formliners are assembled as discussed herein. Accordingly, such a cumbersome formation as well as assembly process may introduce seams into the formliner assembly that may be visible in the curable material. As shown, the free end 221 of the second wall 220 does not extend into the cell volume 105. The free end 221 may extend such that it is adjacent to the cell volume 105.

The free end 221 may not be adjacent to the cell volume 105. For example, the second wall 220 may have a shorter length such that the free end 221 is not adjacent to the cell volume 105 or the cell 104 (e.g., the free end 221 is positioned anywhere along a length of the second wall 230).

Many advantages arise from these configurations of the formliners 100B, 100C. One advantage is a structurally sound interface that is convenient to assemble and to disassemble. For example, the overlapped section 120 may have increased stiffness and weight bearing capabilities (e.g., against the weight of the curable material) due in part to the third wall 240. The third wall 240 may extend downward as previously discussed and as shown in FIGS. 4A-4B and thereby provide increased stiffness to the overlapped section 120 along the length of the overlapped section 120. Such increased step stiffness may facilitate handling of the formliners without deforming or otherwise damaging them. Further, increased stiffness of the overlapped section 120 may provide a more robust interface that is less susceptible to deformation of the weight of the curable material therein by the third wall 240 abutting or resting on support/resting surface as discussed herein and preventing/inhibiting vertical (e.g., downward) movement of the second wall 230 (and correspondingly, the first and second wall 204, 220) along a longitudinal length of the third wall 240 that may be perpendicular to the base 103 or bottom surface 111 as discussed herein. For example, the third wall 240 may help inhibit the second wall 220, 230 from becoming disjointed (e.g., separating from being in direct contact with each other because of kinking/bending) when the curable material is poured against the formliners 100. The curable material may expand or contract within the cells 104. Having the robust interface shown will mitigate damage or deformation due to this and other influences of the curable material.

Another advantage from the shown interface is that there is little or substantially no interference with the curable material inside the cells. For instance, the second wall 220 may not enter the cell volume 105 and thereby may not interfere with the curable material within that cell 104 such as, for example, not form a seam in the curable wall along the cell volume 105. By extending the second wall 220 so that it is adjacent (but not in) the cell volume 105 there will be fewer or no discontinuities visible in the resulting cured material pattern. For instance, the free end 221 of the second wall 220 may align with a portion or portions of the first wall 205 such that a continuous surface along the ribs 102 or boundary 115 is produced when the two formliners 100C and 100B are assembled as shown. By forming a continuous surface the resulting cured material will have fewer visible discontinuities or seams.

FIG. 4B is a cross-section view of a portion of the assembly 300 as taken along the line 4B-4B as indicated in FIG. 3A. The interface shown in FIG. 4B may have similar features and functionalities as that shown and described with respect to FIG. 4A. However, the interface is between the formliner 100B and the formliner 100A. As oriented in FIG. 4B, the overlapped section 120 and the overlapping section 130 are now on opposite sides as that shown in FIG. 4A. However, similar features and functionalities may apply to the interface in FIG. 4B as those of FIG. 4A, and this view is shown to merely exemplify another interface for other sections of the formliners.

For illustration and discussion purposes, a support surface 406 is added to FIG. 4B. As shown in FIG. 4B, the bottom surface 111 and/or third wall 240 (e.g., free end 241) may wholly, partially, substantially contact, abut, come against a support surface 406. The support surface can be the platform 606 as discussed herein, and in particular, in reference to FIG. 6. The support surface 406 may be the ground, floor, or other stable surface (e.g., a tabletop) against which a formliner rests in a desired position. Such contacts against a support surface 406 can provide support, structural integrity (substantial resistance to deformation given a desired curable material), and weight bearing capabilities to the respective formliners 100 and/or boundaries 115 as discussed herein. While the bottom surface 111 is illustrated to substantially wholly come against or contact the support surface 406, some portions or parts of the bottom surface 111 may not contact the support surface 406 (with other portions correspondingly contacting the support surface 406) where the base 103 (and correspondingly the bottom surface 111) has a textured pattern as discussed herein.

FIG. 4C is a cross-section view of a portion of the assembly 300 as taken along the line 4C-4C as indicated in FIG. 3A. As shown, the formliner 100B may interface with the formliner 100C. The formliner 100B may interface with the formliner 100C at the transition zone 107C. The transition zone 107C may be an area or region of the formliners where adjacent formliners interface with each other when assembled together. As shown, the transition zone 107C of the formliner 100C may include a vertical step (or variable cross-section transition) between the internal rib section 108C and the overlapped section 120C. However, the transition zone 107C need not be a vertical step. The transition zone 107C may be a variety of other configurations, such as angled, rounded, multiple segments, other shapes, or combinations thereof. Therefore, the configuration shown is merely one possible transition zone and many others may be implemented.

As shown, the transition zone 107C may connect the internal section 108C to the overlapped section 120C. Therefore, the ribs 102 of the formliner 100C may include an overlapped section 120C extending toward and connecting with the transition zone 107C, which in turn may connect with the internal section 108C. Further, as shown, the two adjacent sections of the transition zone 107C may be at different heights. The internal section 108C may be at a higher height (e.g., different or longer length or distance from a base 103) than the overlapped section 120C as oriented in FIG. 4C. The internal section 108C may be at a higher height than the overlapped section 120C such that the internal section 108C will form a substantially continuous surface with the adjacent formliner 100B when assembled together. As shown, the top surfaces of the overlapping section 130B and the internal section 108C form a generally continuous surface. Thus, the transition zone 107C may provide a means by which two adjacent formliners may form a substantially continuous surface. By "substantially continuous" it is meant that the resulting pattern formed using the assembled formliners would be acceptable to one of ordinary skill in the art (e.g., minimized or substantially absent seam formed in the curable material). Therefore, there may be a small gap in between adjacent formliners at the transition zone 107C.

As shown, the transition zone 107C allows the formliner 100C to receive the formliner 100B such that the overlapping section 130B is generally coplanar with the internal section 108C (e.g., external surfaces of the ribs 102 are substantially flush). As further shown, the overlapping section 130B may be at least partially on top of the overlapped section 120C. Further, as shown, the upper and lower portions of the transition zone 107C as oriented may have generally the same contour. That is, both the upper and lower surfaces of the transition zone 107C may have a similar vertical step, or other similar contour. However, this may not be the case. The upper and lower portions of the transition zone 107C may have different contours. The upper portion of the transition zone 107C may have a vertical step as shown, while the lower portion may have a different contour. For example, the upper portion of the transition zone 107C may have the vertical step as shown while the lower portion of the transition zone 107C may have an angled, rounded or other contour. Furthermore, the lower portion of the transition zone 107C need not have any transition at all. For instance, the lower portion of the transition zone 107C may merely be a continuation of the lower surface of the overlapped section 120C. While the transition zone 107C as shown and described in FIG. 4C has been taken at one particular location of the assembly 300, is understood that the features and functionalities described with respect to this transition zone 107C may apply equally to other transition zones of the assembly 300.

Figure 5A:
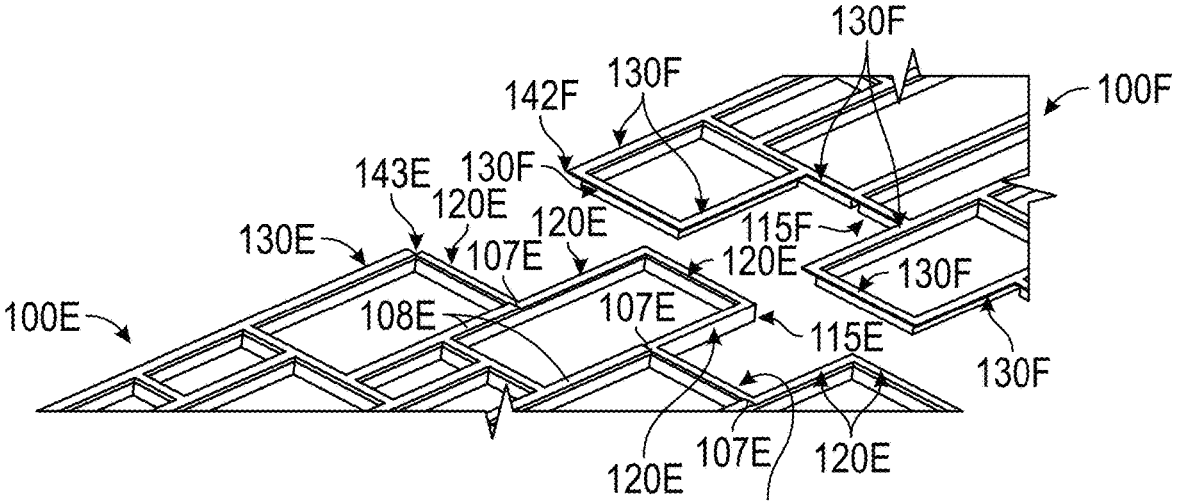
FIG. 5A is an exploded view of an assembly of two formliners.

FIG. 5A is an exploded view of an assembly of two adjacent formliners 100E and 100F. The formliner 100E may include a boundary 115E which may include an overlapped section 120E extending for a portion thereof. The formliner 100F may include a boundary 115F that may have an overlapping section 130F extending along a portion thereof. The overlapped section 120E of the formliner 100E and the overlapping section 130F of the formliner 100F may be brought into contact or otherwise adjacent one another. The overlapping section 130F may receive the overlapped section 120E. By "receive" it is meant that the overlapping section 130F may be overlaid (e.g., coupled, assembled, connected interconnected) onto or otherwise next to the overlapped section 120E.

The formliner 100E may be assembled with the formliner 100F by bringing the respective overlapped sections 120E and overlapping sections 130F together. The respective sections may be brought together in a variety of manners. The formliner 100E may be laid down on a platform of a framework, described in further detail herein, for example with respect to FIG. 6. The formliner 100F may be lowered onto the formliner 100E such that the overlapping section 130F overlaps with the overlapped section 120E. The formliner 100E may be laid down first and then the formliner 100F may be slid adjacent to the formliner 100E. Therefore, the various formliners may be brought together in a variety of ways. When the formliner 100F is brought together with the formliner 100E, the second corner 142F of the formliner 100F may be adjacent to the third corner 143E of the formliner 100E.

When the two formliners 100E, 100F are brought together, the overlapping section 130F of the formliner 100F may be adjacent to the various transition zones 107E of the formliner 100E. Therefore, the overlapping sections 130F of the formliner 100F may form a substantially continuous surface (e.g., substantially flush exterior surfaces of the ribs 102) with portions of the internal section 108E of the formliner 100E. Further, when the formliner 100E and the formliner 100F are assembled together, they may appear, for example, similar to the formliners 100A and 100D shown in FIG. 3A, or similar to the formliners 100B and 100C as shown in FIG. 3A.

As shown in FIG. 5A, the two formliners 100E, 100F have complementary finger joint patterns. The finger joint pattern of formliner 100E extends from the third corner 143E along the overlapped section 120E. Only part of this finger joint pattern is shown. Similarly, the finger joint pattern of formliner 100F extends from the second corner 142F along the overlapping section 130F. Only a portion of this finger joint pattern is shown. The two finger joint patterns are complementary to each other such that when the two formliners 100E, 100F are brought together they will form an elongated formliner assembly that is longer than any one individual formliner 100E, 100F.

Figure 5B:
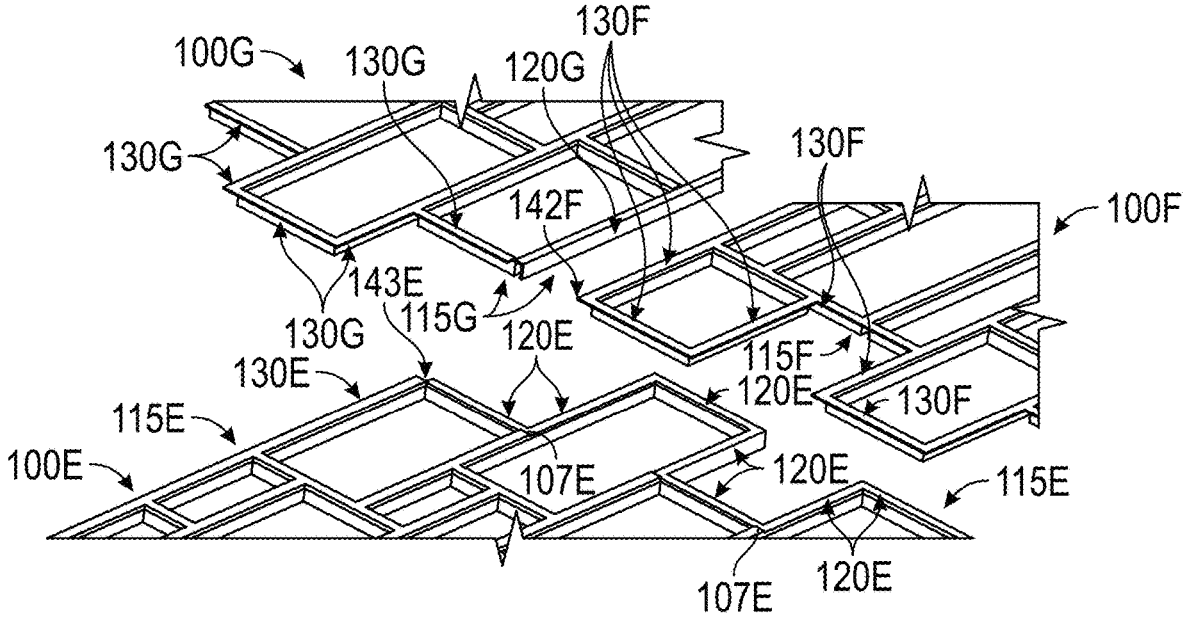
FIG. 5B is an exploded view of an assembly of three formliners.

FIG. 5B is an exploded view of three formliners 100E, 100F, 100G assembled together. The formliners 100E and 100F may be assembled in a similar manner as described with respect to FIG. 5A. The formliner 100G may be assembled with the formliners 100E and 100F. Therefore, the second corner 142F of the formliner 100F may be adjacent to the third corner 143E of the formliner 100E when the three formliners 100E, 100F, 100G are assembled together. Further, the overlapped section 120G of the formliner 100G may be adjacent to the portion of the overlapping section 130F of the formliner 100F that is adjacent the overlapped section 120G of the formliner 100G as oriented in the figure. Therefore, the portion of a boundary 115G of the formliner 100G may be adjacent to this portion of the overlapping section 130F of the formliner 100F when the three formliners 100E, 100F, 100G are assembled together.

The formliner 100E and the formliner 100F may first be assembled together and then the formliner 100G may be assembled with the two assembled formliners 100E, 100F. A fourth formliner can be assembled before or after assembling formliner 100G such that the fourth formliner couples with formliners 100E, 100G as discussed herein. However, this is merely one example. The formliner 100F may first be assembled with the formliner 100G, and then the formliner 100E may be assembled with the formliner 100F. The formliners 100E, 100G may be laid down on a platform of a framework, and then the formliner 100F (before or after the fourth formliner) may be assembled simultaneously with the formliners 100E, 100 G. These are merely some examples of how the formliners may be assembled together, and many other suitable assemblies maybe implemented.

The formliner 100G may also include an overlapping section 130G as shown. This overlapping section 130G may be assembled with an overlapped section of the fourth formliner as discussed herein.

Figure 6:
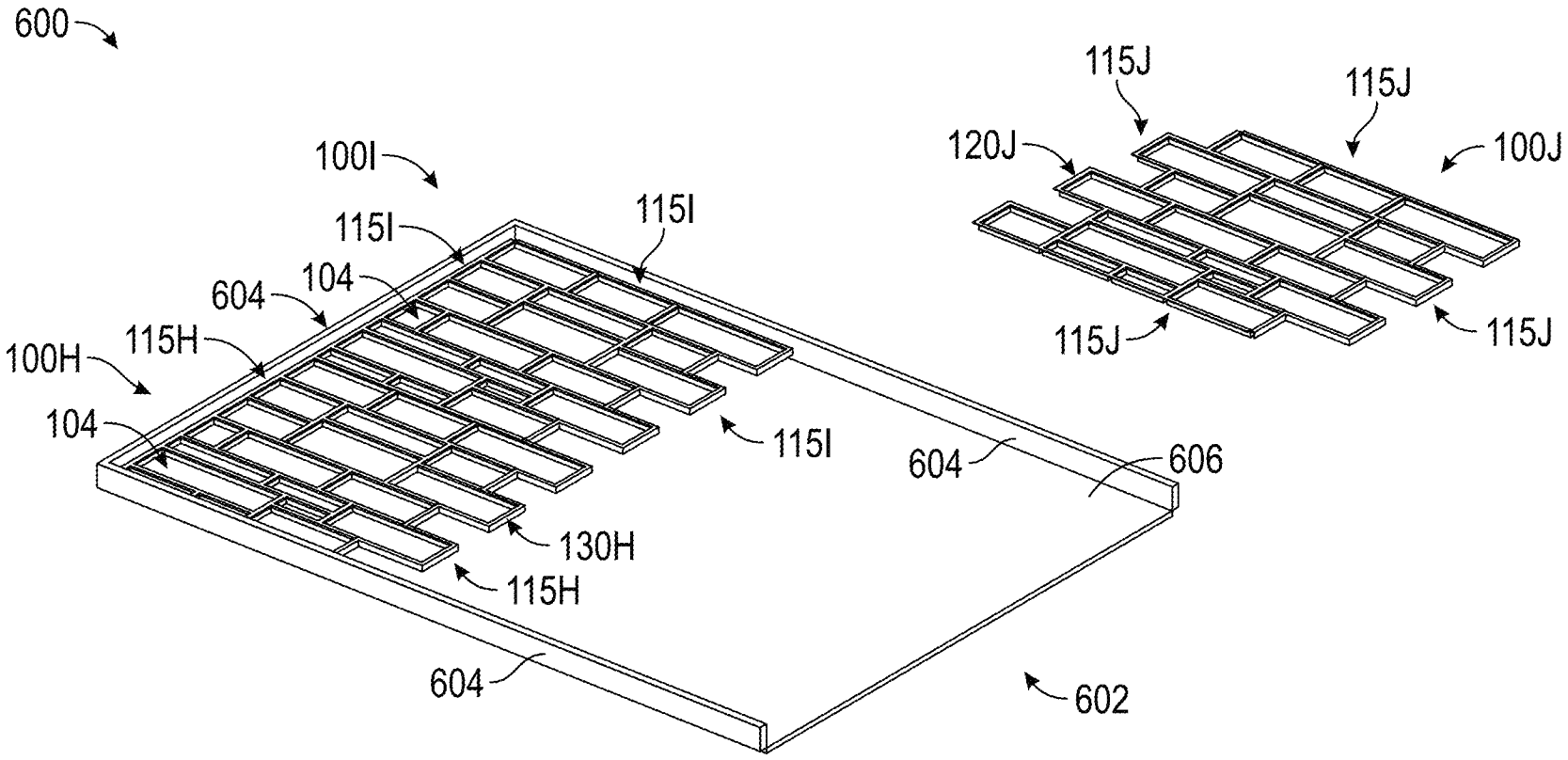
FIG. 6 is a perspective view of an assembly of a framework and several formliners to be used with the framework for forming a pattern in a curable material.

FIG. 6 is a perspective view of an assembly 600 including various formliners and a framework 602. The formliners may be assembled together with the framework 602 in order to orient the formliners properly. The framework 602 may further constrain or substantially prevent/inhibit movement of the formliners in a desired position while the curable material is poured thereon to form a pattern.

The framework 602 may include a perimeter segment 604 that encloses the formliners therein. The perimeter segment 604 may be a wall as shown that may enclose the formliners therein and/or substantially prevent/inhibit the curable material from spilling outside the framework 602. The perimeter segment 605 may have a height (e.g., vertical length) greater than a height (e.g., vertical length) of the formliners to substantially prevent/inhibit the curable material from spilling outside the framework 602. The perimeter segments 604 may be "two by fours." There may be three or four perimeter segments 604 that form, respectively, a partially or fully an enclosed space therein.

The assembly 600 may include a platform 606 (e.g., a backing, base, bottom, support surface, plane). The perimeter segments 604 may be on or adjacent to the platform 606. The platform 606 may be a generally planar surface on or to which the formliners may be positioned or attached. The platform 606 may be sheet-metal or plywood or other suitable materials to which the perimeter segments 604 may be connected and on which the formliners may be received. Bottom surfaces 111 and/or third walls 240 (e.g., free ends 241) may wholly, partially, substantially contact, abut, come against the platform 606 to provide support, structural integrity (substantially resistance to deformation given a desired curable material), and weight bearing capabilities to the respective formliners. For example, the base 103 (and correspondingly the bottom surface 111) may have a textured pattern such that some portions or parts of the bottom surface 111 contact the platform 606 while others are not in contact with the platform 606.

It is understood that while three perimeter segments 604 are shown attached to the platform 606, another perimeter segment 604 may also be connected to enclose the formliners on all lateral sides of the platform 606. Further, the assembly of the various perimeter segments 604 may all be made from the same continuous, monolithic piece of material.

The assembly 600 may include the formliners 100H, 100I, 100J. The formliner 100H may be positioned next to the formliner 100I within the framework 602. A boundary 115H of the formliner 100H may be contacting one or more of the perimeter segments 604 of the framework 602. Similarly, a boundary 115I of the formliner 100I may contact one or more of the perimeter segments 604. The boundaries of the formliners may contact the framework 602 in more than one location. For example, the boundary 115I of the formliner 100I may contact the perimeter segment 604 of the framework 602 along two sides of the formliner 100I. One end of the formliner 100I with a finger joint pattern along the boundary 115I may contact one perimeter segment 604 of the framework 602, while another side of the formliner 100I at a different part of the boundary 115I may contact a different perimeter segment 604 of the framework 602. As shown, projecting cells 104 adjacent or near the perimeter segment 604 can be trimmed or cut such that a continuous pattern may formed in the curable material starting from the perimeter segments 604.

A third formliner 100J may be assembled with the two formliners 100H, 100I within the framework 602. As shown, the formliner 100J may have a boundary 115J which may be brought to contact the boundary or boundaries of the other formliners in the framework. For example, the boundary 115J may be brought to contact the boundary 115I of the formliner 100I. The boundary 115J may also be brought to contact various portions of the framework 602. For example, a portion of the boundary 115J may be brought to contact the perimeter segment 604 of the framework 602. The formliner 100J may also be brought to rest on the platform 606 of the framework 602. The boundary 115J of the formliner 100J may therefore partially contact the boundary 115I of the formliner 100I and partially contact one or more of the perimeter segments 604 of the framework 602. The boundary 115J of the formliner 100J may be brought to contact the boundary 115H of the formliner 100H. These are merely some examples of how the assembly 600 may be assembled, and other suitable configurations may be implemented. Similarly, a fourth or many more formliners may be joined within the framework 602.

While there has been illustrated and described what are presently considered to be example embodiments, it will be understood by those skilled in the art that various other modifications may be made, and equivalents may be substituted, without departing from claimed subject matter. Additionally, many modifications may be made to adapt a particular situation to the teachings of claimed subject matter without departing from the central concept described herein. Therefore, it is intended that claimed subject matter not be limited to the particular embodiments disclosed, but that such claimed subject matter may also include all embodiments falling within the scope of the appended claims, and equivalents thereof.

It is contemplated that various combinations or subcombinations of the specific features and aspects of the embodiments disclosed above may be made and still fall within one or more of the inventions. Further, the disclosure herein of any particular feature, aspect, method, property, characteristic, quality, attribute, element, or the like in connection with an embodiment can be used in all other embodiments set forth herein. Accordingly, it should be understood that various features and aspects of the disclosed embodiments can be combined with or substituted for one another in order to form varying modes of the disclosed inventions. Thus, it is intended that the scope of the present inventions herein disclosed should not be limited by the particular disclosed embodiments described above. Moreover, while the inventions are susceptible to various modifications, and alternative forms, specific examples thereof have been shown in the drawings and are herein described in detail. It should be understood, however, that the inventions are not to be limited to the particular forms or methods disclosed, but to the contrary, the invention is to cover all modifications, equivalents, and alternatives falling within the spirit and scope of the various embodiments described and the appended claims. Any methods disclosed herein need not be performed in the order recited.

The ranges disclosed herein also encompass any and all overlap, sub-ranges, and combinations thereof. Language such as "up to," "at least," "greater than," "less than," "between," and the like includes the number recited. Numbers preceded by a term such as "approximately", "about", and "substantially" as used herein include the recited numbers, and also represent an amount close to the stated amount that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount. Features of embodiments disclosed herein preceded by a term such as "approximately", "about", and "substantially" as used herein represent the feature with some variability that still performs a desired function or achieves a desired result for that feature.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced embodiment recitation is intended, such an intent will be explicitly recited in the embodiment, and in the absence of such recitation no such intent is present. For example, as an aid to understanding, the disclosure may contain usage of the introductory phrases "at least one" and "one or more" to introduce embodiment recitations. However, the use of such phrases should not be construed to imply that the introduction of an embodiment recitation by the indefinite articles "a" or "an" limits any particular embodiment containing such introduced embodiment recitation to embodiments containing only one such recitation, even when the same embodiment includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce embodiment recitations. In addition, even if a specific number of an introduced embodiment recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, embodiments, or drawings, should be understood to contemplate the possibilities of including one of the terms, either of the terms, or both terms. For example, the phrase "A or B" will be understood to include the possibilities of "A" or "B" or "A and B."

Although the present subject matter has been described herein in terms of certain embodiments, and certain exemplary methods, it is to be understood that the scope of the subject matter is not to be limited thereby. Instead, the Applicant intends that variations on the methods and materials disclosed herein which are apparent to those of skill in the art will fall within the scope of the disclosed subject matter.

What is claimed is:

1. A formliner for use with a framework to create a decorative pattern on curable material, the formliner comprising:

a cell comprising a base configured to face the curable material, wherein the base is configured to extend along a backing of the framework and at least a part of the base is configured contact the backing of the framework, wherein the framework is configured to support the formliner in a desired position; and a rib system comprising a plurality of ribs extending along the cell and forming at least a part of a boundary of the cell, the plurality of ribs comprising:

an overlapping section connected with the cell and comprising a first rib edge, the overlapping section configured to face the curable material in use, the first rib edge being a free end of the overlapping section;

an overlapped section connected with the cell and comprising a second rib edge, at least a portion of the overlapping section configured to overlay onto at least a portion of the overlapped section; and a cutout at a corner of the formliner, the first rib edge of the overlapping section and the second rib edge of the overlapped section at least partially forming the cutout with the first rib edge being the free end of the overlapping section along the cutout, wherein an inner periphery is formed where the overlapped section connects with the base of the cell, the inner periphery extending generally along the boundary of the cell and configured to extend generally along the framework, wherein the first rib edge is configured to extend along the boundary of the cell without contacting the inner periphery of the cell with the at least a portion of the overlapping section overlaid onto the at least a portion of the overlapped section, and wherein the second rib edge extends along the boundary of the cell, the second rib edge configured to extend toward the backing of the framework such that the second rib edge is configured to provide structural support to the overlapped section and the overlapping section with the at least a portion of the overlapping section overlaid onto the at least a portion of the overlapped section.

2. The formliner of claim 1, comprising an other cutout at an other corner of the formliner, the first rib edge of the overlapping section and the second rib edge of the overlapped section at least partially forming the other cutout with the first rib edge being the free end of the overlapping section along the other cutout.

3. A formliner for creating a decorative pattern on curable material, the formliner comprising:

a cell having a contact surface; and a rib system including a plurality of ribs extending along the cell and forming at least a part of a boundary of the cell, the plurality of ribs comprising:

a first section connected with the cell and comprising a first rib end, the first section configured to face the curable material in use, the first rib end being a free end of the first section; a second section connected with the cell and comprising a second rib end, at least a portion of the first section configured to overlay onto at least a portion of the second section; and a cutout at a corner of the formliner, in the plurality of ribs, the first rib end of the first section and the second rib end of the second section at least partially forming the cutout with the first rib end being the free end of the first section along the cutout, wherein a perimeter is formed where the second section connects with the cell, the perimeter extending along the boundary of the cell, wherein the first rib end is configured to extend along the boundary of the cell without contacting the perimeter of the cell with the at least a portion of the first section overlaid onto the at least a portion of the second section, and wherein the second rib end is configured to extend adjacent to a lower portion of the first section with the at least a portion of the first section overlaid onto the at least a portion of the second section.

4. A formliner for use in creating a decorative pattern on curable material, the formliner comprising:

a cell comprising a base configured to face the curable material; and a rib system extending along the cell, the rib system comprising:

a first wall extending upwardly from the base;

a second wall extending from first wall substantially in parallel with an extent of the base;

a third wall extending downwardly from the second wall toward the extent of the base;

a fourth wall extending upwardly from the base;

a fifth wall extending from fourth wall substantially in parallel with the extent of the base, the fifth wall being a free end of the rib system; and a cutout at a corner of the formliner, in the rib system, the cutout formed by free ends of the second wall, the third wall, and the fifth wall, wherein the fifth wall is configured to overlap the second wall.

5. The formliner of claim 1, wherein the overlapping section comprises a first wall and a second wall connected to the first wall, wherein the overlapped section comprises a first wall, a second wall connected to the first wall of the overlapped section, and a third wall connected to the second wall of the overlapped section, wherein the first wall of the overlapping section is configured to overlap the third wall of the overlapped section, and wherein the second wall of the overlapping section is configured to overlap the second wall of the overlapped section.

6. The formliner of claim 5, wherein the second wall of the overlapping section comprises the first rib edge of the overlapping section.

7. The formliner of claim 5, wherein the third wall of the overlapped section comprises the second rib edge of the overlapped section.

8. The formliner of claim 5, wherein the first rib edge is configured to extend along a corner of the overlapped section formed by the second wall of the overlapped section connecting to the first wall of the overlapped section with the at least a portion of the overlapping section overlaid onto the at least a portion of the overlapped section.

9. The formliner of claim 8, wherein the first rib edge is configured to be at the corner of the overlapped section with the at least a portion of the overlapping section overlaid onto the at least a portion of the overlapped section.

10. The formliner of claim 1, wherein the overlapped section connects with the cell at the base of the cell, wherein the inner periphery is formed along the connection between the overlapped section and the base.

11. The formliner of claim 1, wherein the overlapping section has a cross-sectional interior profile configured to overlay onto the overlapped section, wherein an entirety of the cross-sectional interior profile of the overlapping section is configured to overlay onto and be in contact with the overlapped section.

12. A formliner for creating a decorative pattern on curable material, the formliner comprising:

a cell having a contact surface; and a rib system including a plurality of ribs extending along the cell and forming at least a part of a boundary of the cell, the plurality of ribs comprising:

a first section connected with the cell and comprising a first rib end, the first section configured to face the curable material in use, the first rib end being a free end of the first section; a second section connected with the cell and comprising a second rib end, at least a portion of the first section configured to overlay onto at least a portion of the second section; and a cutout in the plurality of ribs, the first rib end of the first section at least partially forming the cutout with the first rib end being a free end of the first section along the cutout, wherein a perimeter is formed where the second section connects with the cell, the perimeter extending along the boundary of the cell, wherein the first rib end is configured to extend along the boundary of the cell without contacting the perimeter of the cell with the at least a portion of the first section overlaid onto the at least a portion of the second section, and wherein the second rib end is configured to extend adjacent to a lower portion of the first section with the at least a portion of the first section overlaid onto the at least a portion of the second section.

13. The formliner of claim 12, wherein the second rib end comprises an ending edge of the plurality of ribs extending along the cutout.

14. The formliner of claim 12, wherein the lower portion of the first section is between the first rib end and the cell.

15. The formliner of claim 12, wherein the first section comprises a first wall and a second wall connected with the first wall, wherein the second section comprises a first wall, a second wall connected with the first wall of the second section, and a third wall connected with the second wall of the second section, wherein the first wall of the first section is configured to overlap the third wall of the second section, and wherein the second wall of the first section is configured to overlap the second wall of the second section.

16. The formliner of claim 15, wherein the first wall of the first section comprises the lower portion of the first section.

17. The formliner of claim 12, wherein the first section forms a first cross- sectional profile and the second section forms a second cross-sectional profile having a length, wherein the first cross-sectional profile is configured to overlap the second cross-sectional profile over about two-thirds of the length with the at least a portion of the first section overlaid onto the at least a portion of the second section.

18. The formliner of claim 12, wherein the second section connects with the cell at the contact surface of the cell, wherein the perimeter is formed along the connection between the second section and the contact surface.

19. The formliner of claim 12, wherein a first formliner is configured to be connected with a second formliner by overlaying at least a portion of a first section of the second formliner onto at least a portion of a second section of the first formliner such that an exterior surface of the first section of the second formliner is flush with an exterior surface of a rib system of the first formliner, wherein the exterior surface of the rib system is configured to face the curable material.

20. The formliner of claim 19, wherein the rib system further comprises:

a plurality of non-overlap ribs; and a transition zone between the non-overlap ribs and the second section, the transition zone connecting the second section with the non-overlap ribs, and wherein a first rib end of the second formliner is configured to be positioned adjacent a transition zone of the first formliner with the first and second formliners assembled together.

21. The formliner of claim 20, wherein the transition zone comprises a varying cross-sectional profile increasing from the second section to the non-overlap ribs.

22. The formliner of claim 12, wherein the formliner comprises a plurality of cells, and wherein the plurality of ribs are disposed between the plurality of cells to form a plurality of boundaries of the cells.

23. The formliner of claim 12, wherein the contact surface comprises a textured pattern bounded by the rib system, wherein the textured pattern is configured to form a textured surface in an exposed surface of the curable material where the contact surface comprising the textured pattern is configured to directly contact the exposed surface of the curable material.

24. A formliner for use in creating a decorative pattern on curable material, the formliner comprising:

a cell comprising a base configured to face the curable material; and a rib system extending along the cell, the rib system comprising:

a first wall extending upwardly from the base;

a second wall extending from first wall substantially in parallel with an extent of the base;

a third wall extending downwardly from the second wall toward the extent of the base;

a fourth wall extending upwardly from the base;

a fifth wall extending from fourth wall substantially in parallel with the extent of the base, the fifth wall being a free end of the rib system; and a cutout in the rib system, the cutout formed by free ends of the second wall, the third wall, and the fifth wall, wherein the fifth wall is configured to overlap the second wall.

25. The formliner of claim 24, wherein the fifth wall has a length substantially equal to an extent of the second wall, the extent of the second wall substantially parallel to the extent of the base.

26. The formliner of claim 24, wherein the fifth wall is configured to extend from the fourth wall substantially to an edge formed by the second wall connecting to the first wall with the fifth wall overlapped onto the second wall.

* * * * *